United States Patent [19]

Wong

[11] Patent Number: 4,506,246

[45] Date of Patent: Mar. 19, 1985

[54] INTERLOCK SCHEME FOR HIGH AMPERAGE MOLDED CASE CIRCUIT BREAKER

[75] Inventor: Tak M. Wong, Swisher, Iowa

[73] Assignee: Square D Company, Palatine, Ill.

[21] Appl. No.: 493,111

[22] Filed: May 9, 1983

[51] Int. Cl.[3] ..... H01H 3/30; H01H 83/12

[52] U.S. Cl. ..... 335/164; 335/160; 335/77; 200/153 SC

[58] Field of Search ..... 335/76, 160, 161, 164, 335/18-20; 200/153 G, 153 SC, 50 R, 50 AA

[56] References Cited

U.S. PATENT DOCUMENTS 3,198,906 8/1965 Frink et al. ..... 335/77

3,559,121 1/1971 Powell et al. ..... 200/153 SC 3,590,192 6/1971 Bould ..... 200/153 SC

*Primary Examiner*—E. A. Goldberg

*Assistant Examiner*—George Andrews

*Attorney, Agent, or Firm*—Larry I. Golden; Richard T. Guttman; Norton Lesser

[57] ABSTRACT

An interlock assembly for a high amperage molded case circuit breaker is provided with a slide biased to interfere with movement of a push to close link whose operation enables discharge of the breaker closing spring. The slide is operated by the toggle assembly in the event the contacts are open to permit operation of the link except if the breaker is being tripped or held tripped. A trip solenoid of the permanent magnet type is reset, when tripped, by a reset spring under control of blade carrier which has excess energy available.

12 Claims, 48 Drawing Figures

FIG. 2a
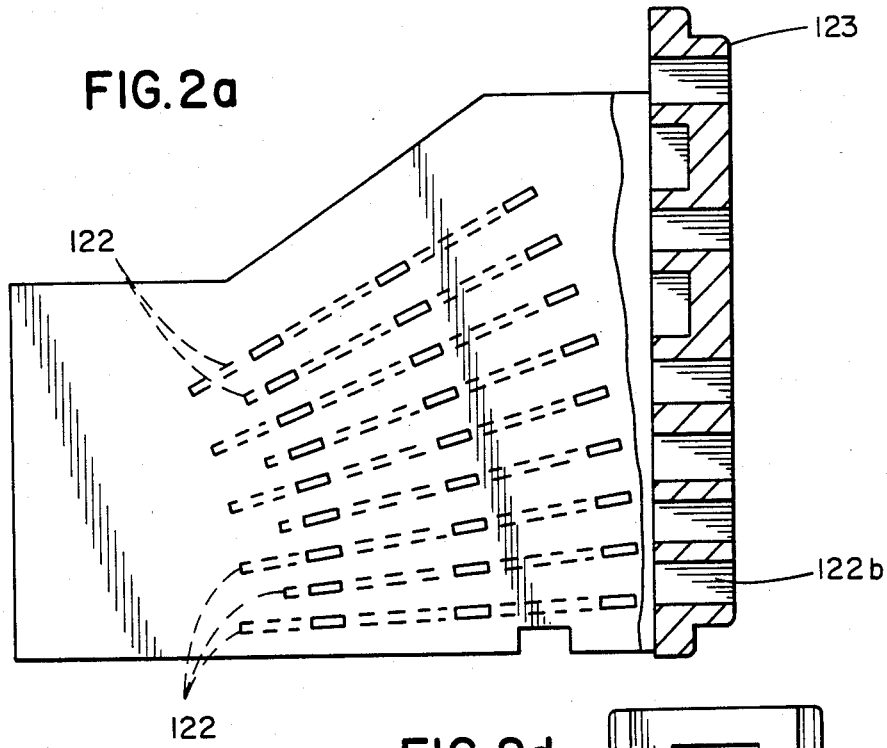
FIG. 2d
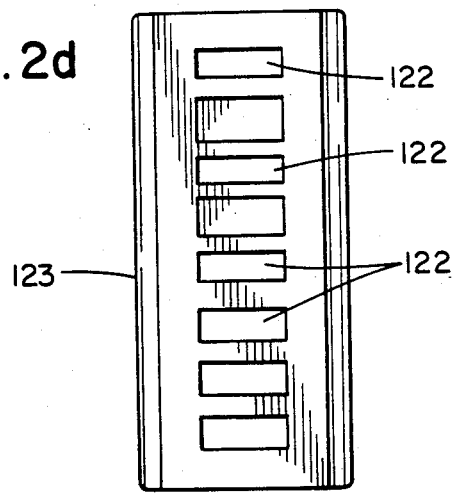
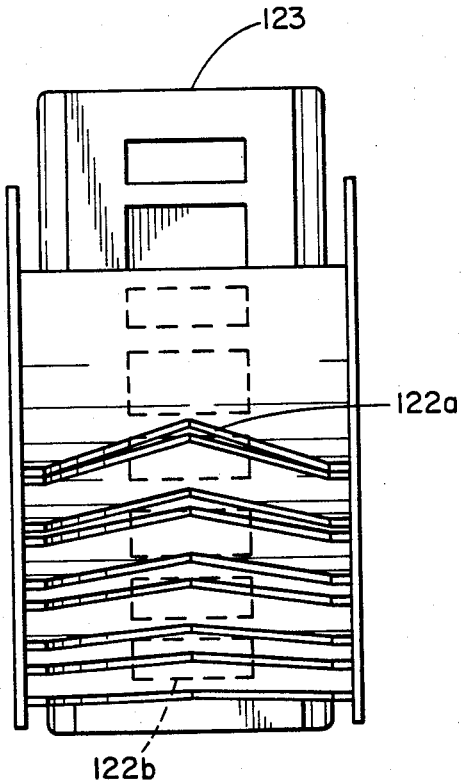
FIG. 2b
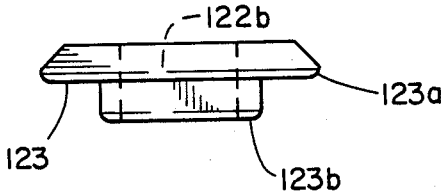
FIG. 2c

INTERLOCK SCHEME FOR HIGH AMPERAGE MOLDED CASE CIRCUIT BREAKER

FIELD OF THE INVENTION

The present invention relates in general to circuit interrupting apparatus and more particularly to an improved and more economical high amperage molded case circuit breaker.

BACKGROUND OF THE INVENTION

High amperage molded case circuit breakers are required to interrupt large values of current extended through a plurality of downstream breakers to respective loads. Problems of course arise both from the blade and contact mass required to carry the large current values and the forces required for the closure of the contacts necessitate a relatively large closing spring.

A closing spring is required to store energy for contact closure in the event the breaker is tripped and power lost and the closing spring must be large to close the contacts against the force of the overtravel springs which initially tend to resist contact opening in response to a momentary current rise or surge. The closing spring which is used to provide the contact closing energy is generally charged or tensed through a mechanism under control of either an electrically driven motor or a manually operable link arrangement and then released to erect a toggle assembly, which moves the blades through blade carriers into a contact closed position.

It is customary in breakers of the described type to maintain the closing spring tensed so that after each discharge, the closing spring is recharged. This enables the contacts to again be closed after having been tripped open or manually opened, and avoids the need for an electrical power source to close the contacts after tripping. An interlock however must be provided to prevent inadvertent discharge of the closing spring if the contacts are already closed to avoid possible damage or if the breaker is being held tripped.

Electronic circuitry is also provided in breakers of the described type for momentarily operating a trip solenoid to release a latch for enabling collapse of the toggle assembly to open the contacts, but arrangements for interconnecting the trip solenoid with the other apparatus are expensive and the solenoid must be reset after such operation requiring considerable power. Such power is not easily provided by the trip solenoid as the solenoid is normally held in its unoperated condition by a permanent magnet

SUMMARY OF THE INVENTION

The present invention is for use in a molded case circuit breaker carrying currents in ranges between 800 amps and 3000 amps. The breaker includes a closing spring, which is tensed in response to each discharge as described in applications Ser. Nos. 492,905 and 492,901 filed simultaneously herewith respectively by Chabot and Wong and by Chabot for erecting a toggle assembly.

Thereafter discharge of the closing spring to erect the toggle assembly against the force of the blade overtravel springs is provided by a push to close link unless the contacts are already closed or the breaker is held tripped.

To prevent the closing spring from discharging when the breaker contacts are closed or the breaker held tripped or during tripping, an economical interlock assembly is provided. The interlock assembly comprises a pair of spring operated slides one of which is normally positioned to prevent operation of the push to close link and discharge of the closing spring.

The interlock assembly also includes a pair of spring biased arms one of which is operated by the toggle assembly only in its collapsed condition to withdraw the one slide from the path of the push to close link and permit closing spring discharge only if the the other arm is not operated by either the trip solenoid or the latch assembly. Thus if the latch assembly is held operated to hold the breaker tripped or if operated through a magnetic assembly during breaker tripping an actuator operates the other interlock arm to prevent withdrawal of the one slide from the path of the push to close link. The actuator is also operated by the momentary operation of the trip solenoid to operate the other interlock arm and thereby also prevent discharge of the closing spring.

In addition the trip solenoid assembly is provided with a spring biased reset arm and a reset link interconnected with one of the blade carriers for moving the reset arm from the solenoid armature and tensing the associated spring when the blade carrier is moved to a contact closed position. Then when the carrier is released pursuant to collapse of the toggle assembly by operation of the trip solenoid the spring associated with the reset arm moves the reset arm to reset the trip solenoid to thereby utilize the power of the released blade carrier for resetting the solenoid so that the solenoid need not be supplied the power for both operation and resetting.

It is therefore an object of the present invention to provide an improved and more economical molded case circuit breaker of the type utilized for interrupting high currents.

Other objects and features of the present invention will become apparent on examination of the following specification and claims together with the accompanying drawings.

BRIEF DESCRIPTION OF THE DRAWINGS

FIG. 2*a* is a side elevational view of the arc suppressor assembly and vent member.

FIG. 2*b* is a front elevational view of the arc suppressor assembly and vent member.

FIGS. 2*c* and 2*d* are respective top and front elevational views of the molded vent member for the arc suppressor assembly.

GENERAL ORGANIZATION OF THE CIRCUIT BREAKER

Figure 1:
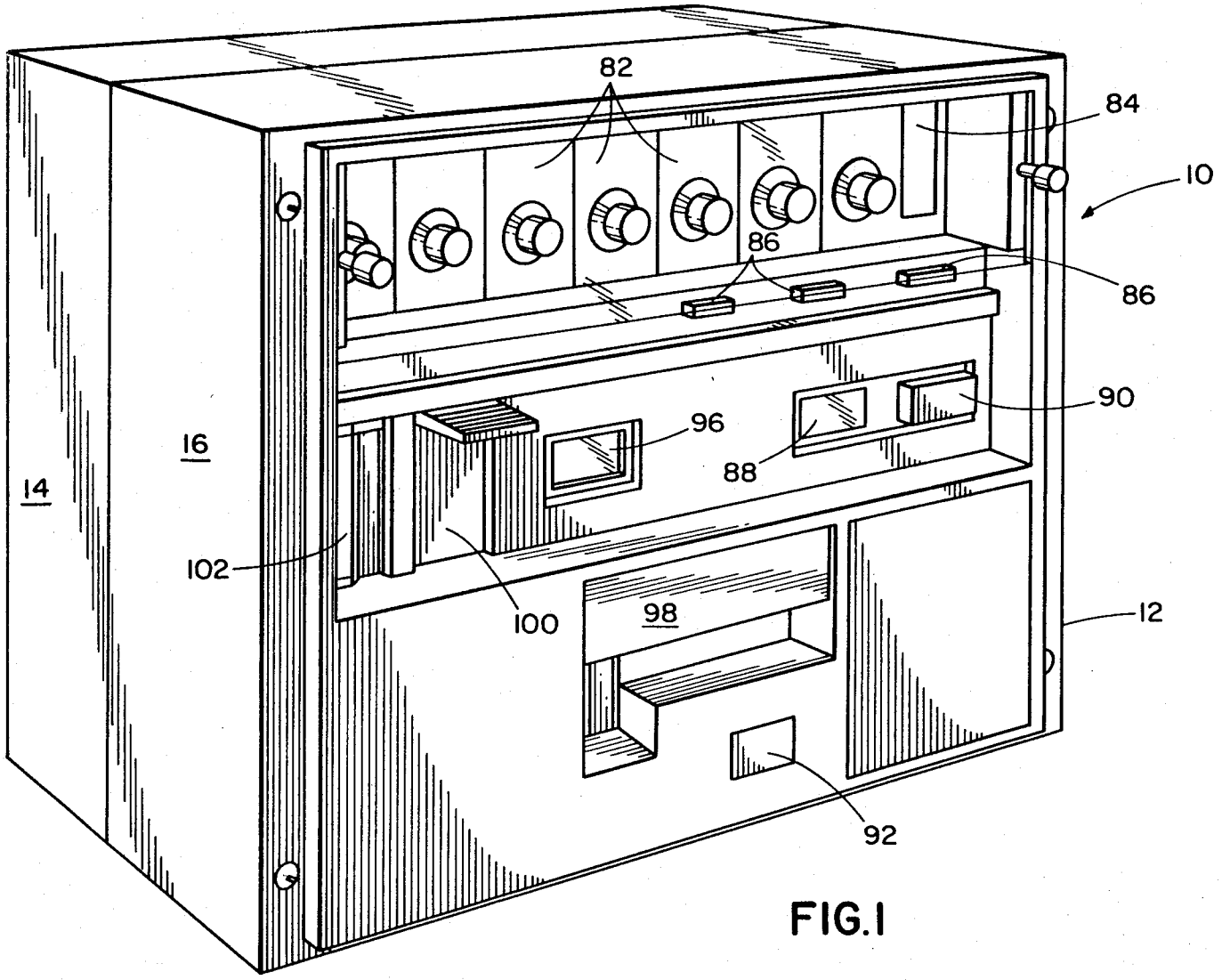
FIG. 1 is a isometric view of a three phase molded case circuit breaker incorporating the principles of the present invention.

A three phase molded case circuit breaker is indicated in FIG. 1 by the reference character 10. The circuit breaker 10 is rated to carry current in selected ranges, for example, between 800–1600 or between 1600 to 3000 amps dependent on the choice of components. The breaker 10 includes a housing 12 having a base 14 and a cover 16 and is adapted to interrupt 85 KA at 600 volts or for example 100 to 150 KA at 480 volts dependent primarily on the choice of material and the number of contacts provided.

The housing 12 has dimensions of only 15½" by 15" by 13" for a breaker carrying currents in the maximum ranges and while a smaller housing and/or some apparatus in the breaker may be altered dependent on the desired functions or current carrying capacity, the apparatus for accomplishing the inventive functions desired in breakers carrying currents in the higher values of the above noted ranges will be described below.

Figure 2:
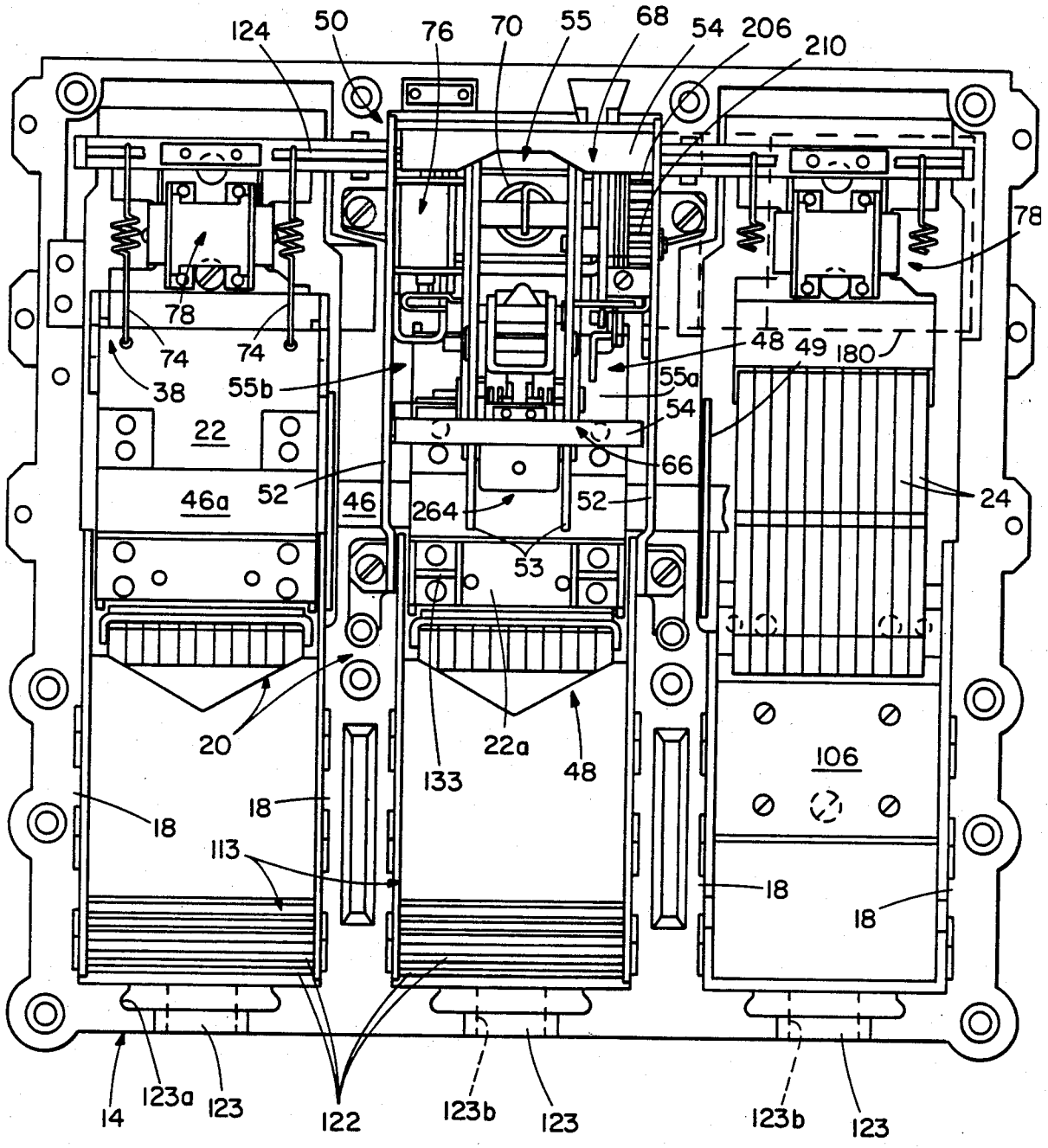
FIG. 2 is a top elevational view of the molded case circuit breaker shown in FIG. 1 with the cover and other assemblies omitted.
Figure 3:
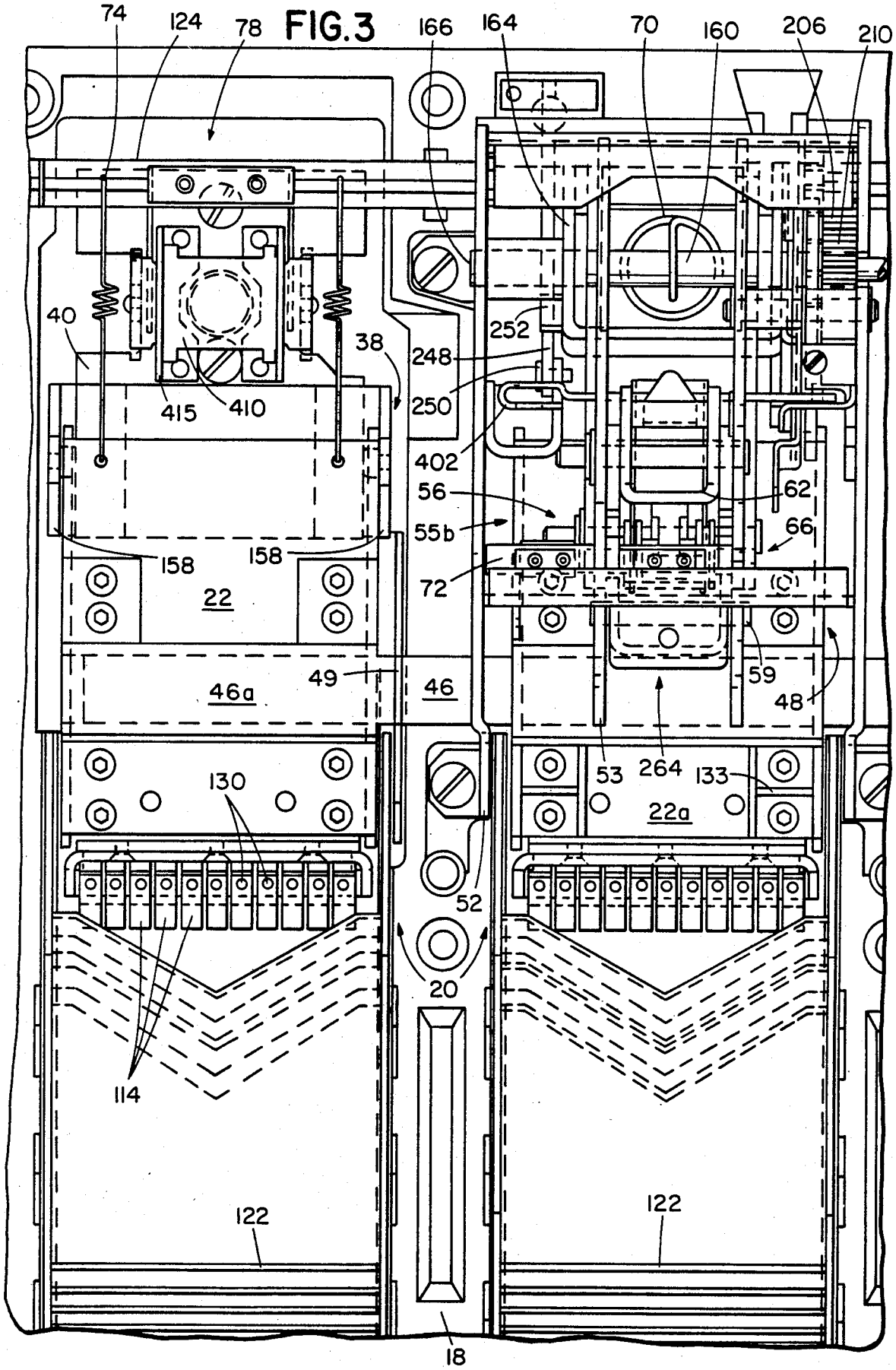
FIG. 3 is an enlarged view similar to FIG. 2 showing the center and one side compartment of the breaker, but omitting the trip solenoid and other assemblies.

The base 14 as seen in FIGS. 2 and 3 includes insulating side and intermediate walls 18 engaged with similar walls of the cover 16 to form a compartment for each phase. A blade assembly 20 is located in each compartment.

Figure 4:
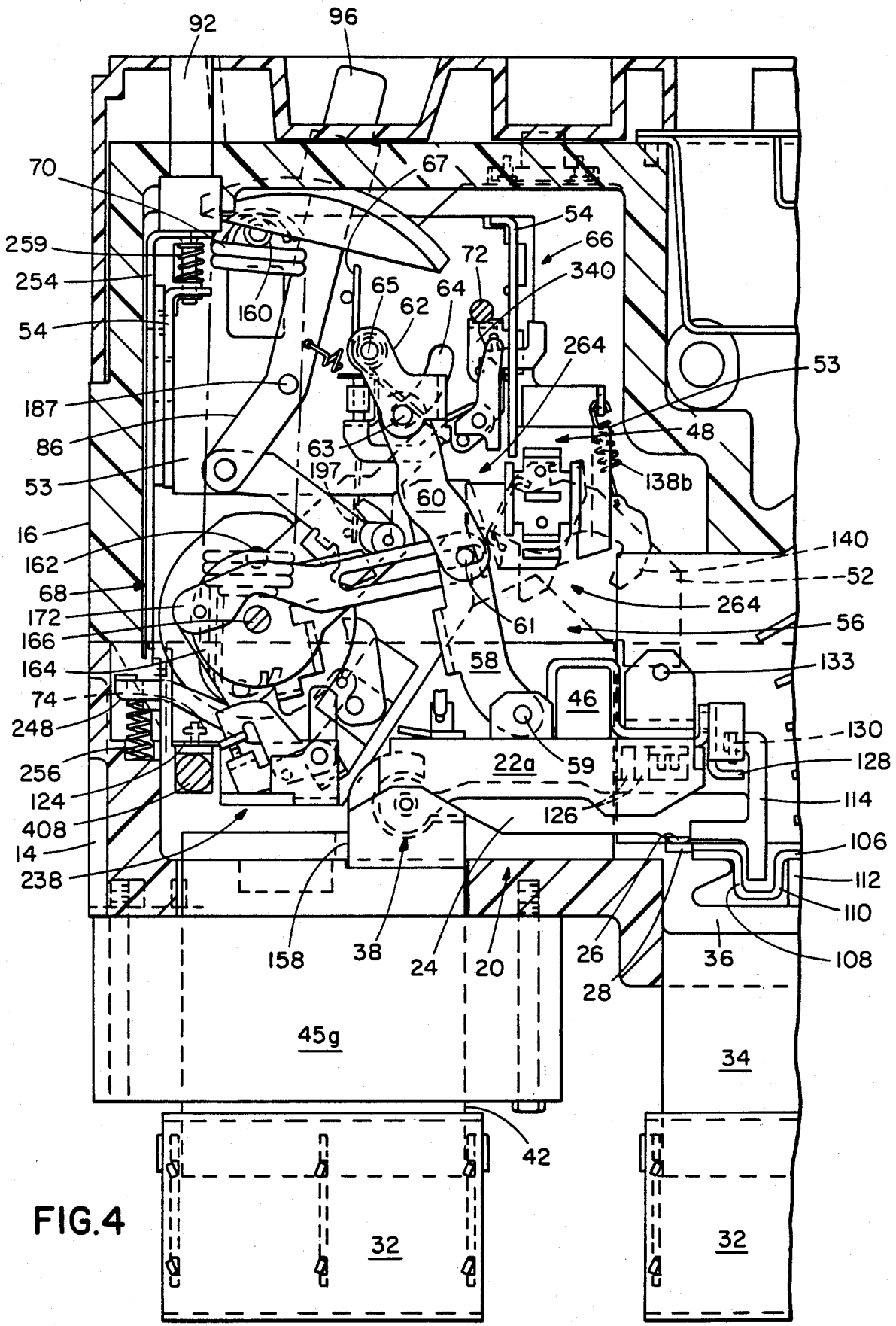
FIG. 4 is a side elevational view of the breaker center compartment taken to generally illustrate the operating and charging assemblies with one wall of the breaker frame assembly and certain control assemblies omitted.
Figure 4B:
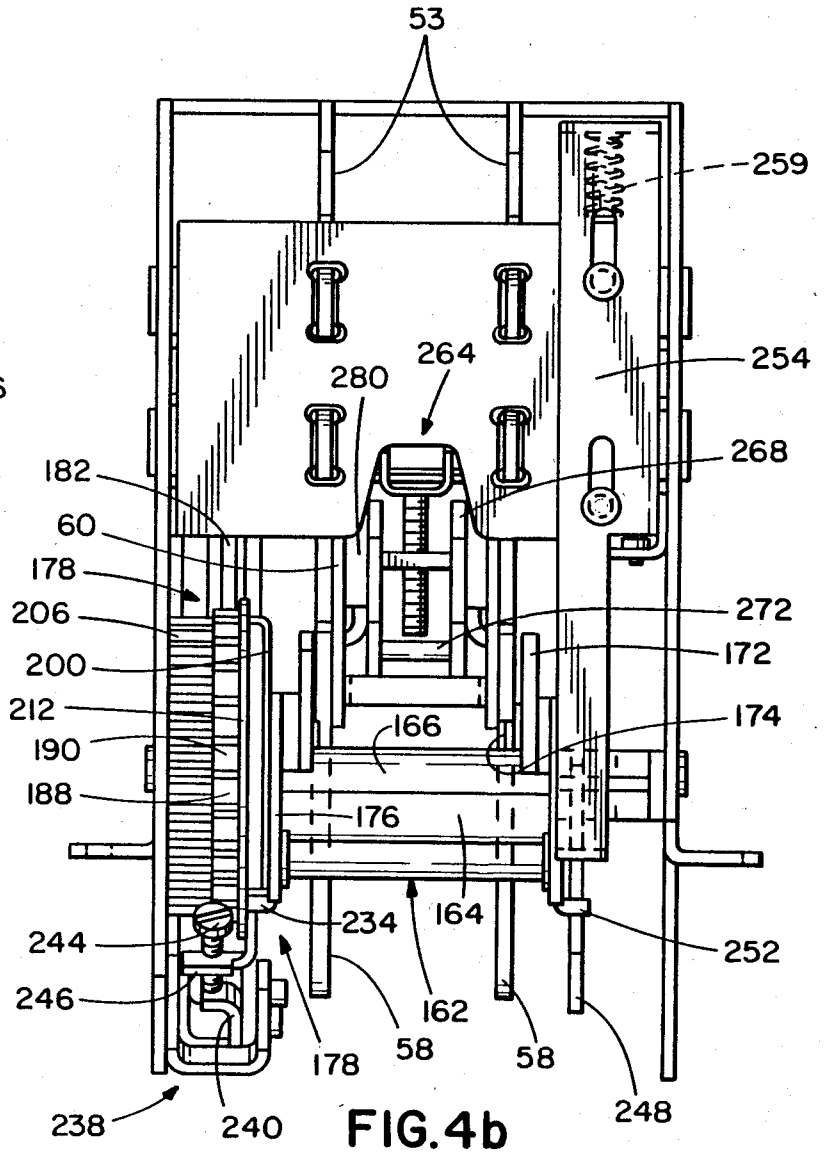
FIG. 4*b* is a rear elevational view of the charge assembly shown in FIG. 4*a*.
Figure 5:
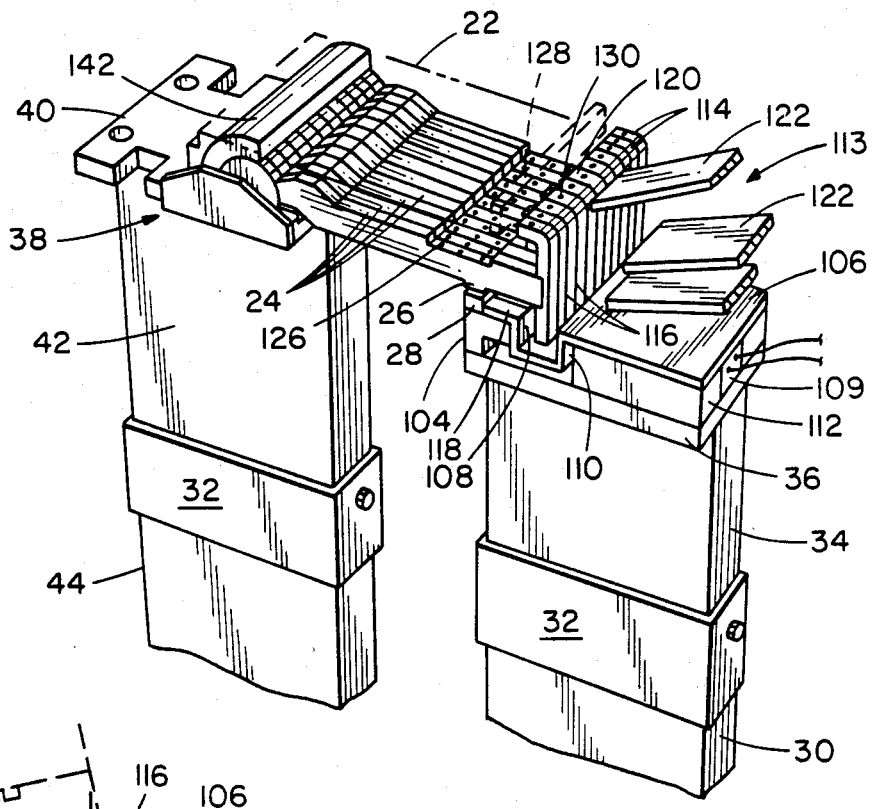
FIG. 5 is a generally isometric view of one blade and pivot assembly with the blade carrier indicated only in part by dashed lines.
Figure 5E:
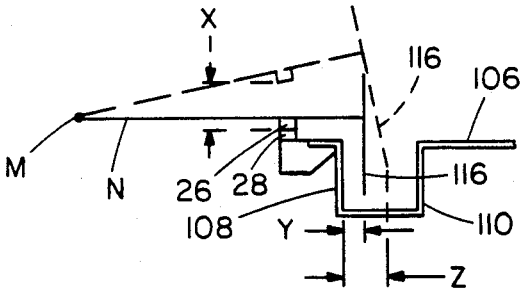
FIG. 5*e* is a schematic view illustrating the manner in which the arc is transferred.
Figure 5D:
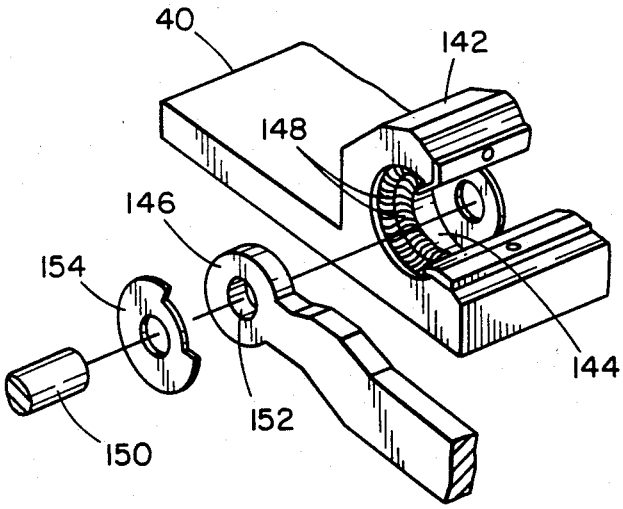
FIG. 5*d* is an isometric view illustrating a portion of the pivot assembly.

The blade assemblies 20 in the side compartments each include a blade carrier 22 and in the center compartment a blade carrier 22*a* is provided with each blade carrier overlapping a plurality of silver plated copper blades 24. Each blade carries a movable contact 26 adjacent one blade end adapted to engage a respective stationary contact 28 as best seen in FIGS. 4, 5 and 5*b*.

The contacts 26 and 28, when engaged, extend a circuit from a respective line bus bar 30, connected through a respective jaw connector assembly 32, line terminal 34 and line conductor 36 to contacts 26 and 28, through a respective copper blade 24, pivot assembly 38, load conductor 40, load terminal 42 and a respective jaw connector assembly 32 to a load bus bar 44. The line and load terminals 34 and 42 project from the bottom wall of the base and each carries the respective connector assembly 32 with some pivotal movement to permit facile alignment of the connector assemblies with the respective bus bars.

Figure 5F:
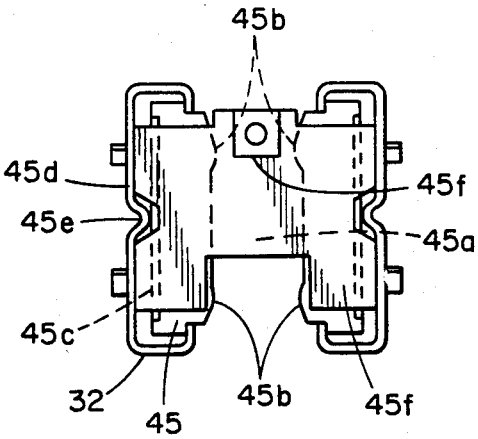
FIG. 5*f* is a side elevational view of one of the jaw connectors.

The connector assemblies 32 are of conventional design and are probably best seen in FIG. 5*f* comprise a plurality of stacked plates 45 defining a passage 45*a* into which a projection 45*b* adjacent opposite ends of each plate 45 extends for engaging the terminals 34 or 42 and bus bars 30 or 44 respectively against the tension of a spring 45*c*. The plates and springs are secured by external brackets 45*d* having a center indentation 45*e* about which the springs are biased to enable the projections 45*b* to firmly grip the terminals and bars. End plates 45*f* are provided with openings to pivotally secure the connectors to the respective terminals.

Current transformers may be conventionally carried by either the line or load terminals 34 and 42 in a housing such as 45*g* secured to the bottom wall of the base for sensing current loads in the conductors as is well known in the art.

The blade assemblies 20 each are interconnected by an electrically insulating blade crossbar 46 secured to the top surface of each blade carrier 22 and 22*a* by means of a respective U-shaped bracket 46*a* for simultaneous movement about the axis provided by pivot assembly 38 under control of an operating assembly 48. Insulating barriers 49 are carried by the blade crossbar 46 to prevent arcing between the breaker compartments.

The operating assembly 48 is supported in a metal frame 50 located in the center compartment of the breaker and secured to the base 14 with the frame 50 including outer side walls 52, intermediate walls 53 together with front and rear end walls 54. Bent tabs on the end walls 54 projecting through the outer side walls 52 and bent tabs on the intermediate walls 53 projecting through the end walls 54 secure the walls to each other in a box like structure having a center frame compartment 55 and side frame compartments 55*a* and 55*b*.

Assembly 48 includes a toggle assembly 56 located in compartment 55 having a U-shaped lower link 58 whose lower end is pivotally interconnected to the carrier 22*a* by a pin 59, as probably best seen in FIG. 4. The upper end of the lower link 58 is connected to the bottom end of a pair of aligned upper links 60 by a follower pin 61 located below the intermediate walls 53 and projecting into compartment 55*b*. The upper end of link 60 is pivotally connected to the lower end of a U-shaped latch link 62 by a pin 63 adapted to move in arcuate slots 64 formed in each of the intermediate walls 53.

Slots 64 extend upwardly and forwardly in walls 53 toward a latch assembly 66 adapted to latch the link 62 for enabling links 58 and 60 to be placed in their erected or aligned position for closing contacts 26 and 28.

The upper end of latch link 62 is pivotally supported between the intermediate frame members 53 by a pin 65 and a torsion spring 67 wrapped about pin 65 biases pin 63 toward the bottom end of slots 64 for enabling the latch assembly 66 to latch the latch link 62. With the link 62 latched, the toggle assembly 56 is erected under control of a charge and crank assembly 68 carried by the frame 50 and having a closing spring 70 located in frame compartment 55. The discharge or release of spring 70 erects the toggle links 58 and 60 to close contacts 26 and 28.

The latch assembly 66 best seen in FIGS. 6, 6*h* and 7–7*b* is operated by a trip shaft 72 to release link 62, which can then pivot counterclockwise about the axis of pin 65 as seen in FIG. 4 while pin 63 moves in slots 64 under the influence of opening springs 74. The opening springs 74 are located in the breaker side compartments and initially pivot the blade carriers 22 to open contacts 26 and 28 and collapse the toggle assembly 56 when the latch assembly 66 initially disengages from the latch link 62.

Trip shaft 72 is under control of a trip solenoid assembly 76 best seen in FIGS. 6, 6*a*, 6*g* and 6*h*. Assembly 76 is supported on one of the side walls 53 in a side compartment 55*b* of the frame 50. A magnetic assembly 78 seen, for example, in FIGS. 2, 3, 6, 6*a* and 6*b* supported on respective load conductors 40 is located in each compartment of the breaker to also control the latch assembly 66 to enable collapse of the toggle assembly 56 for opening the contacts 26 and 28. In addition a push to trip or open link 80 permits the trip shaft 72 to be manually operated for opening the contacts 26 and 28.

The cover 16 supports electronic circuitry of the type described in copending application Ser. Nos. 493,115, 492,515 and 492,516 filed respectively by Zylstra; by Zylstra and Venzke and by Zylstra and Jansen simultaneously herewith. Knobs 82 for controlling the electronic circuitry project from the cover and are located below a removable cover window. The knobs 82 permit manual selection of the respective pick up level currents and time delays for the long time delay, short time delay, instantaneous and ground fault control circuits described in the aforementioned applications to in turn control both the operation of the trip solenoid assembly 76 and indicator solenoids carried by the cover 16 and in a manner explained in those applications. The current transformers (not shown) enabling the operation of the electronic circuitry, as already mentioned, are carried in any conventional manner by either the line terminal 34 or the load terminal 42 but are here indicated as carried by the load terminal 42 in housing 45*g*.

Figure 6:
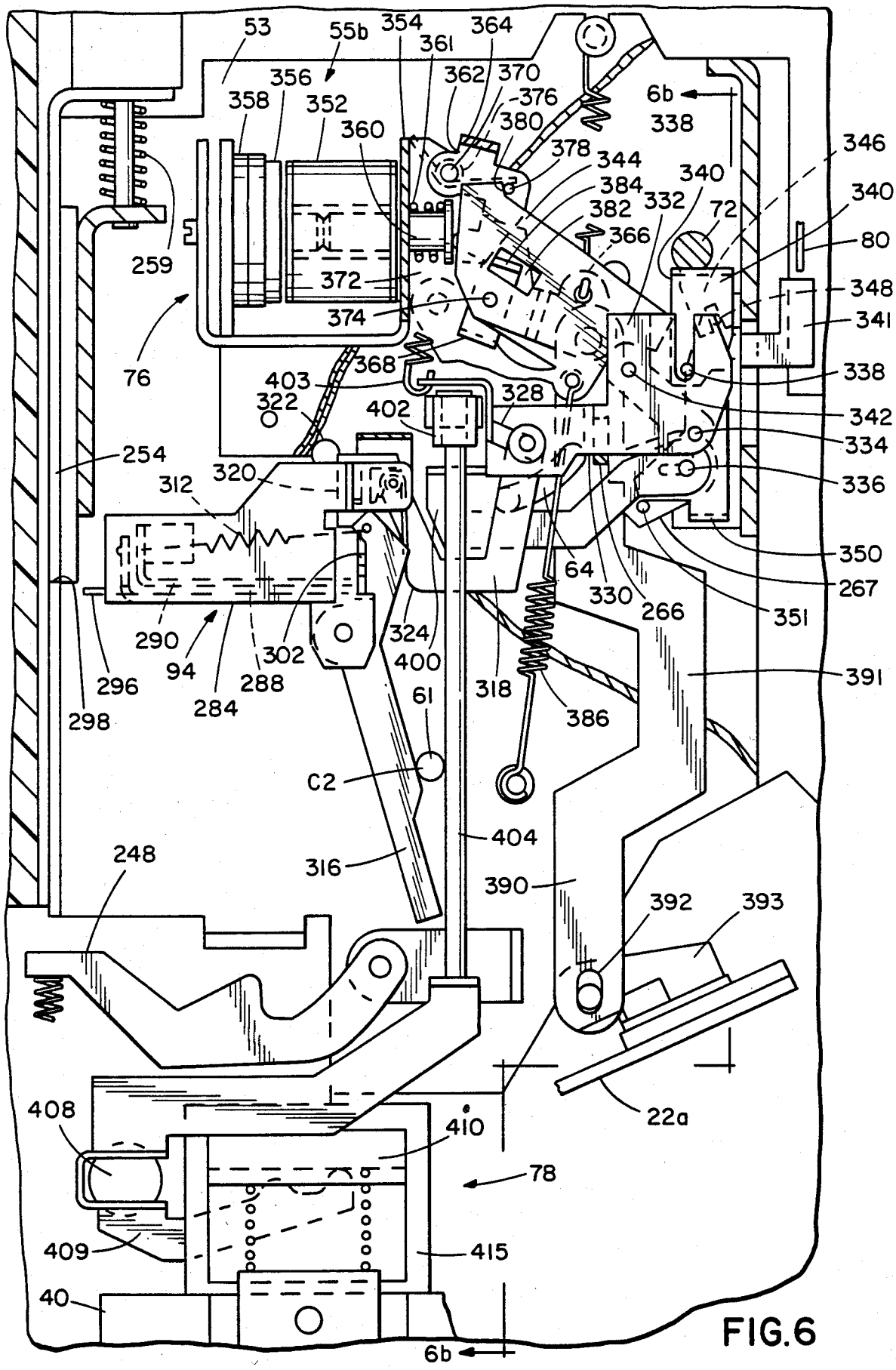
FIG. 6 is a generally side elevational view of one side frame compartment with the toggle and charge assemblies omitted illustrating the relationship between the interlock, trip solenoid, magnetic and latch assemblies when the contacts are in open position.
Figure 6A:
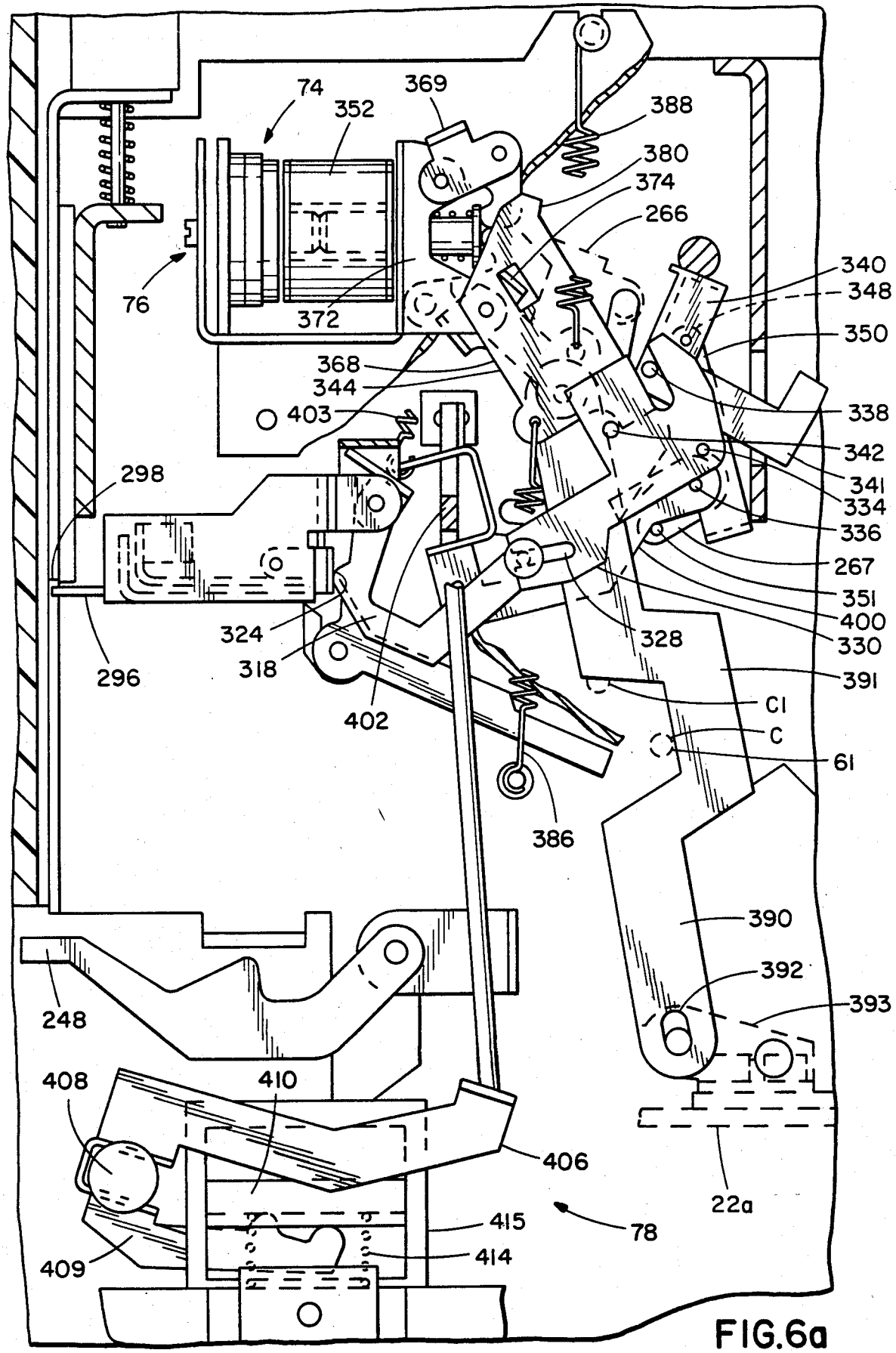
FIG. 6*a* is a view similar to FIG. 6 but illustrating each of the assemblies in FIG. 6 in operated condition before the blade carrier is moved from a closed position, but also indicating the latch link in open position by dashed lines with the understanding that the blade carrier is then also in open position.
Figure 6B:
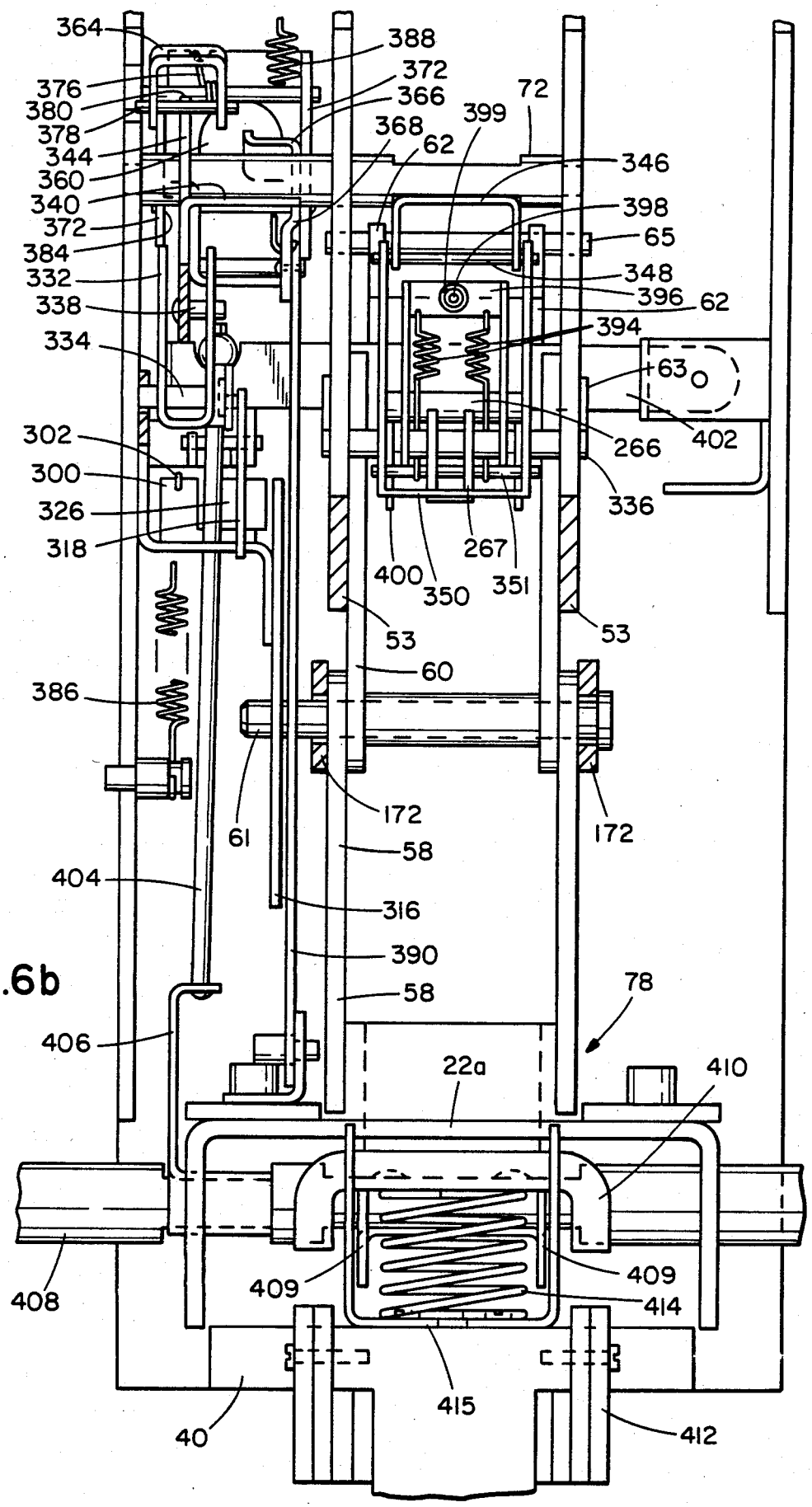
FIG. 6*b* is a sectional view taken generally along the line 6*b*—6*b* in FIG. 6.
Figure 6C:
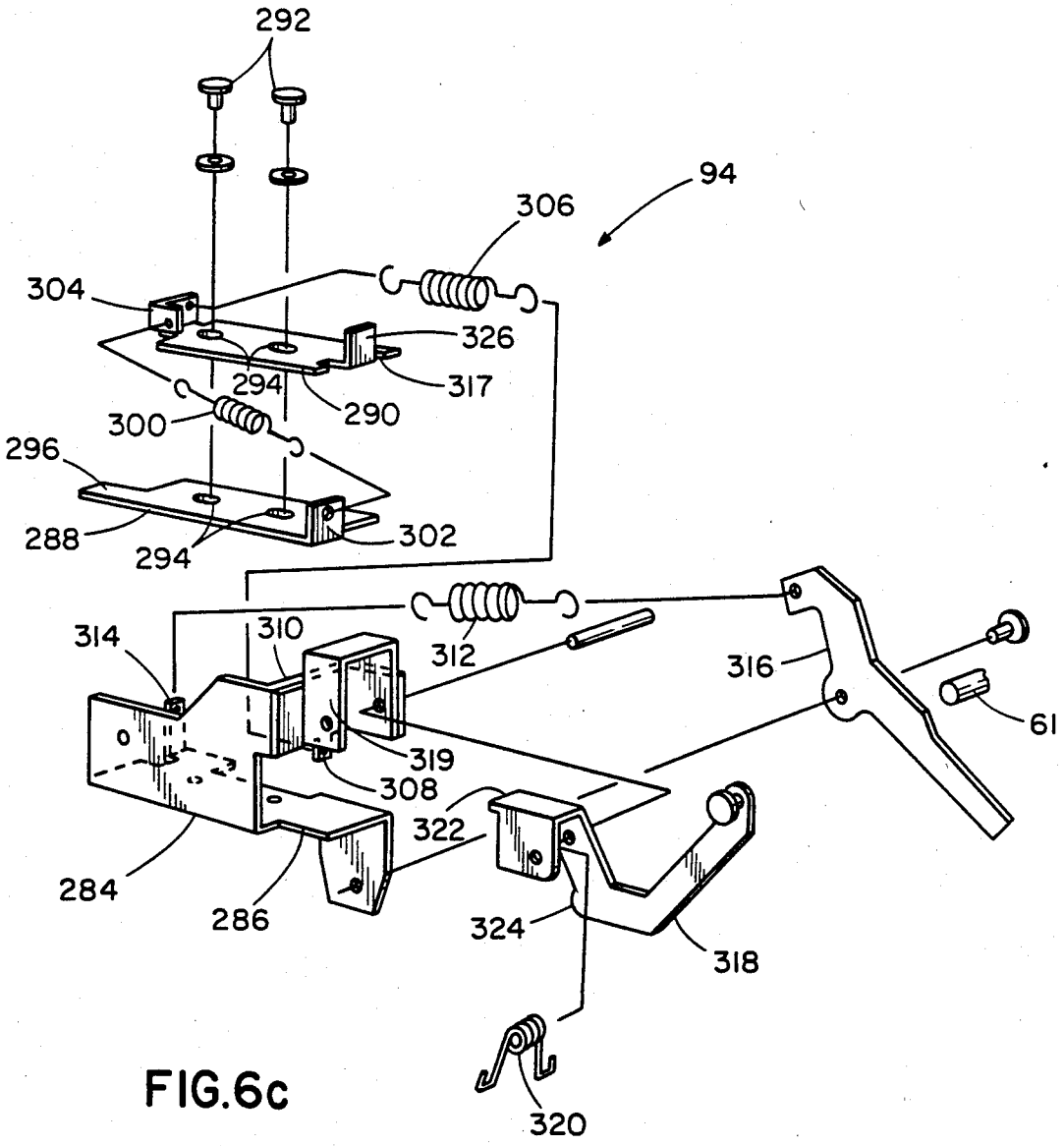
FIG. 6*c* is an exploded isometric view of the interlock assembly shown in FIG. 6.
Figure 6D:
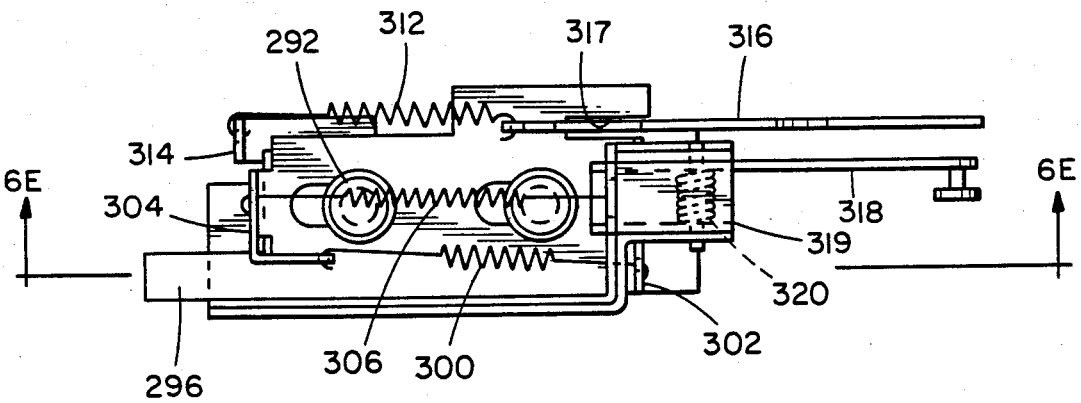
FIG. 6*d* is a top elevational view of the interlock assembly.
Figure 6E:
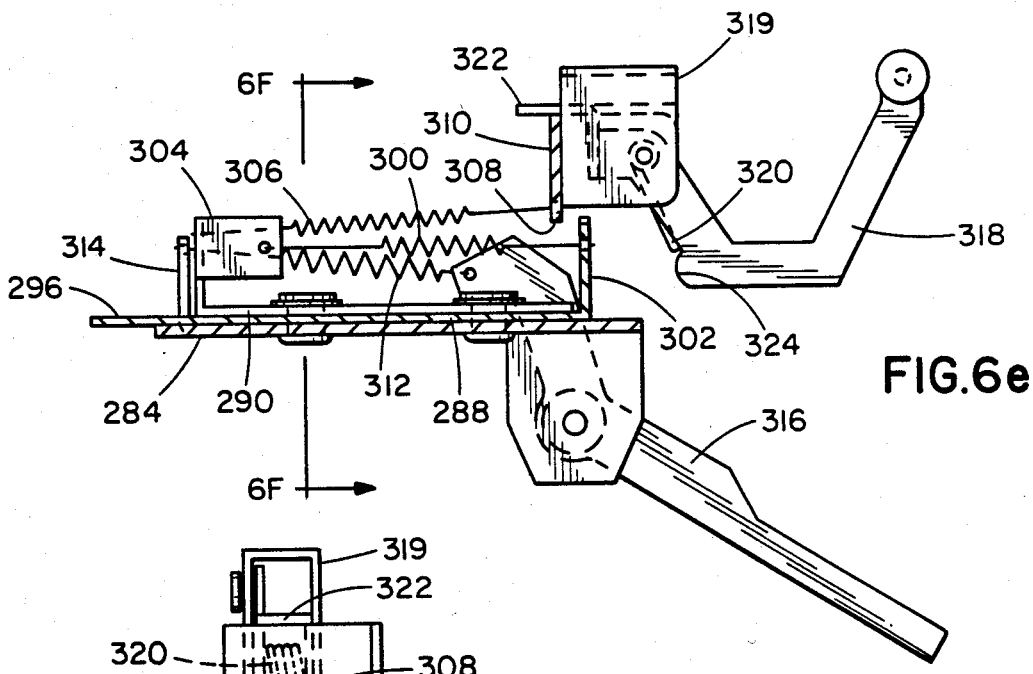
FIG. 6*e* is a sectional view of the interlock assembly taken generally along the line 6*e*—6*e* in FIG. 6*d*.
Figure 6F:
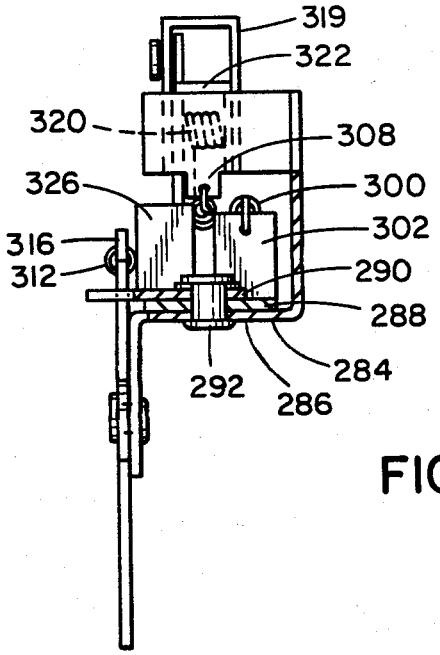
FIG. 6*f* is a sectional view of the interlock assembly taken generally along the line 6*f*—6*f* in FIG. 6*e*.
Figure 6G:
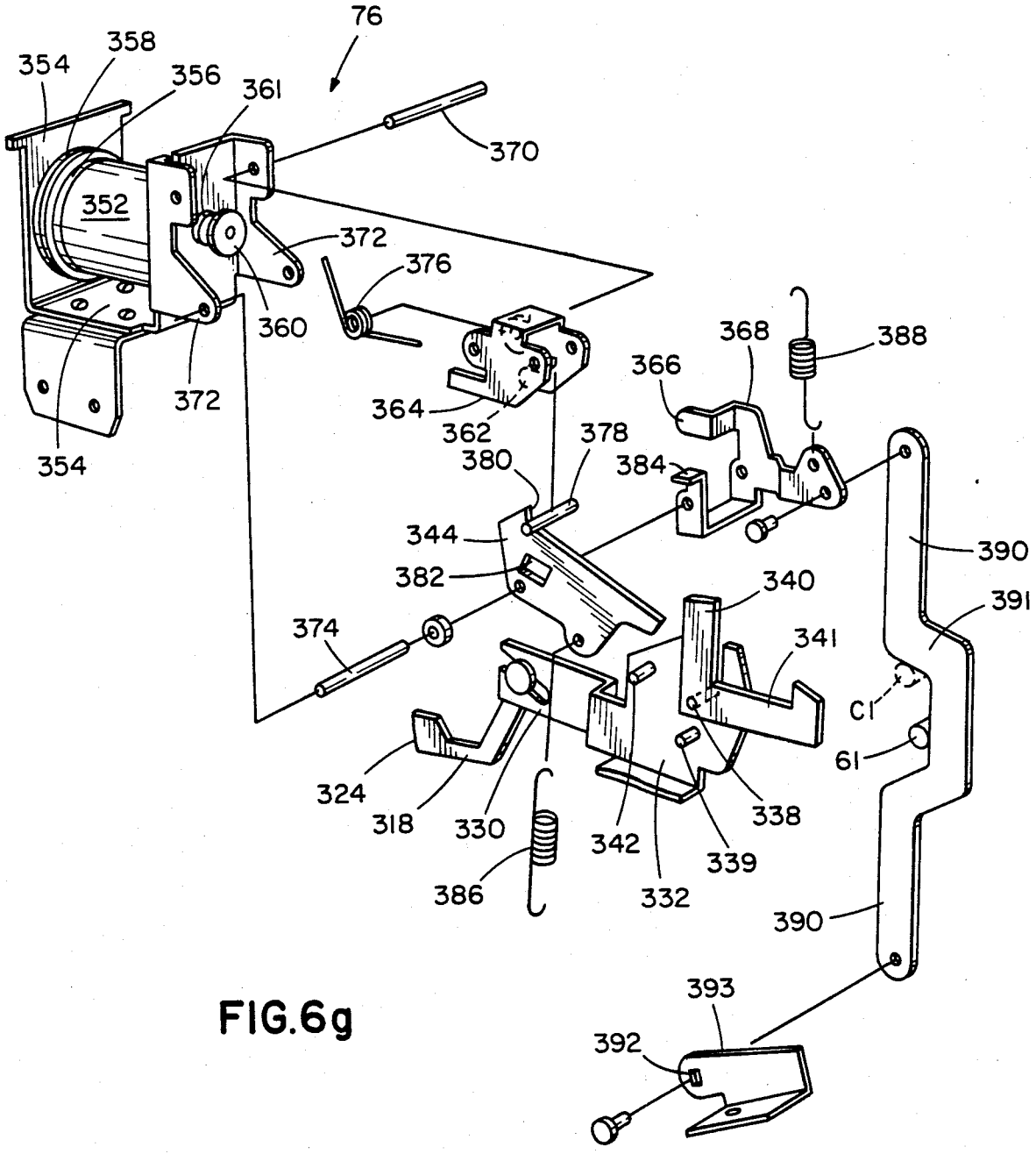
FIG. 6*g* is an exploded isometric view of the trip solenoid assembly.
Figure 6H:
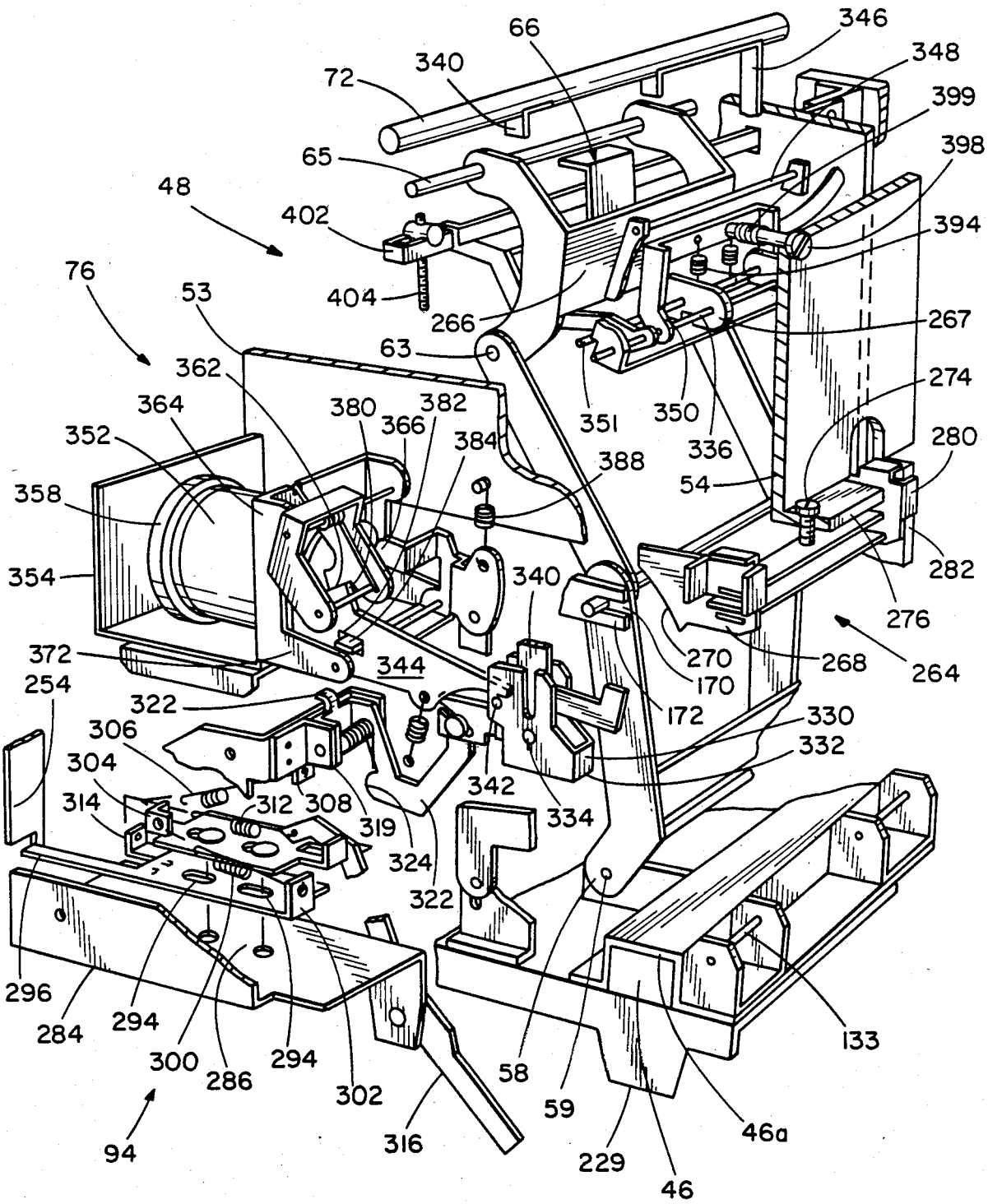
FIG. 6*h* is an exploded view illustrating the interlock, trip solenoid and operating assemblies.

The cover 16 also includes a panel on which are carried a manually replaceable rating plug 84 and indicator lights 86 also located behind the removable window. The indicator lights are respectively under control of the indicator solenoids to indicate the nature of the fault current and under control of a temperature sensor to indicate the temperature of the breaker contacts, while the rating plug serves to select the level of electronic circuit operation in accordance with the breaker rating or range, as explained in the aforementioned applications. An indicator 88 is also provided to conventionally indicate the open or closed position of the breaker contacts. A push to open button or handle 90 controlling link 80 and a push to close button handle 92 extend through the cover 16 for enabling manual opening and closure respectively of contacts 26 and 28 from the panel. The push to close button 92 is operable only when the contacts 26 and 28 are open under control of an interlock assembly 94 carried on one of the walls 53 in frame compartment 55*b* just below the solenoid assembly 76 and is best seen in FIGS. 6–6*f* and 6*h*.

An indicator 96 is also provided on the cover 16 to indicate whether or not the closing spring 70 is charged or discharged. The spring 70 is manually charged or tensed by means of spring charging handle 98 which has a pivoted end folded flush or below the cover panel surface when not in use and which is pivotably supported on the frame 50. Door 100 is provided on the panel for access to the breaker racking mechanism (not shown), which may be of any conventional type and an indicator 102 is provided to indicate in any conventional manner when the terminals 34 and 42 of the breaker are connected to or disconnected from the bus bars 30 and 44. Door 100 may also be conventionally connected to link 80 for tripping the breaker when door 100 is opened to provide access to the racking mechanism.

It will be understood that the cover 16 and base 14 carry complementary connectors for establishing electrical connections between the trip solenoid assembly 76 and the electronic circuitry in the cover and for establishing connections between the current transformers carried by either the load terminal 42 or the line terminal 34 and the electronic circuitry and for such connections as required to provide the indicator or other functions.

DETAILED DESCRIPTION OF THE CIRCUIT BREAKER BLADE ASSEMBLIES

Each blade assembly 20 as mentioned is adapted to extend a circuit from a respective line conductor 36 formed of silver plated copper. Each line conductor is secured to and extends transverse to the longitudinal axis of the respective line terminal 34 as best seen in FIG. 5.

An upstanding end leg 104 is formed on one end of each conductor 36 to support a plurality of stationary contacts 28 for each phase in aligned fixed positions. A recess or cavity is formed behind the leg 104 and intermediate the ends of the conductor 36 to receive U-shaped iron or steel arc runner or plate 106 with the side legs 108 and 110 of the U-shape defining a recess. A temperature sensor or bimetal switch 109 of conventional design may be secured to the conductor 36 adjacent the contacts 26 and 28 to sense the heat generated in the conductor and contacts for enabling an overheated condition to be determined for operating a respective one of the indicators 86, as explained in the aforementioned Zylstra application.

Plate 106 has an arc runner arm extending from side leg 108 to a position adjacent the contacts 28 in overlapping engagement with a rearwardly extending projection on leg 104 and another arc runner arm extending from leg 110 overlaps and engages with a pair of spaced insulating blocks 112 located on conductor 36 to fixedly support the arc runner 106 on the line conductor 36 with the back leg of the U-shape spaced from conductor 36. The arc runner arm extending from side leg 110 is in turn overlapped by an arc suppressor assembly 113. The arc runner arm extending from leg 108 is in turn overlapped, but spaced from an end portion of copper blade 24, which extends beyond the respective contact 26.

Figure 5A:
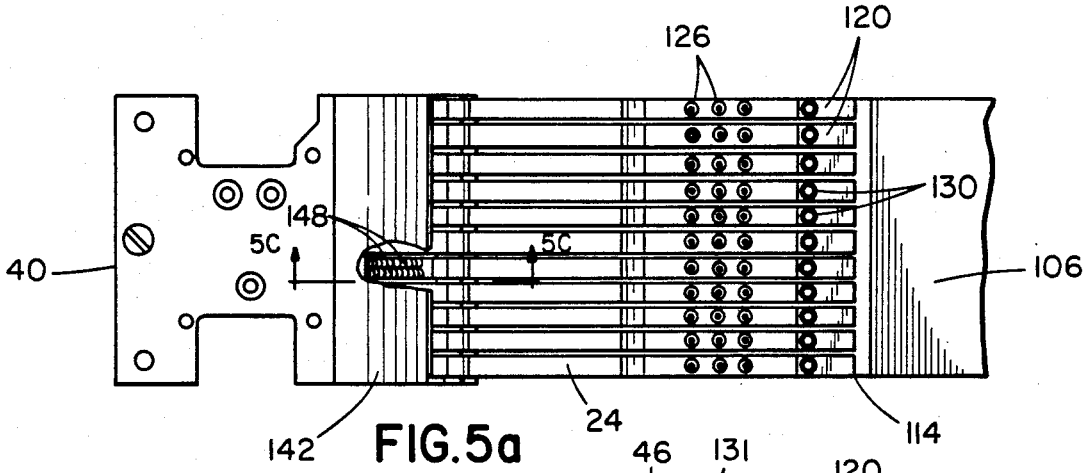
FIG. 5*a* is a top elevational view of the blades and the pivot assembly shown in FIG. 5.
Figure 5B:
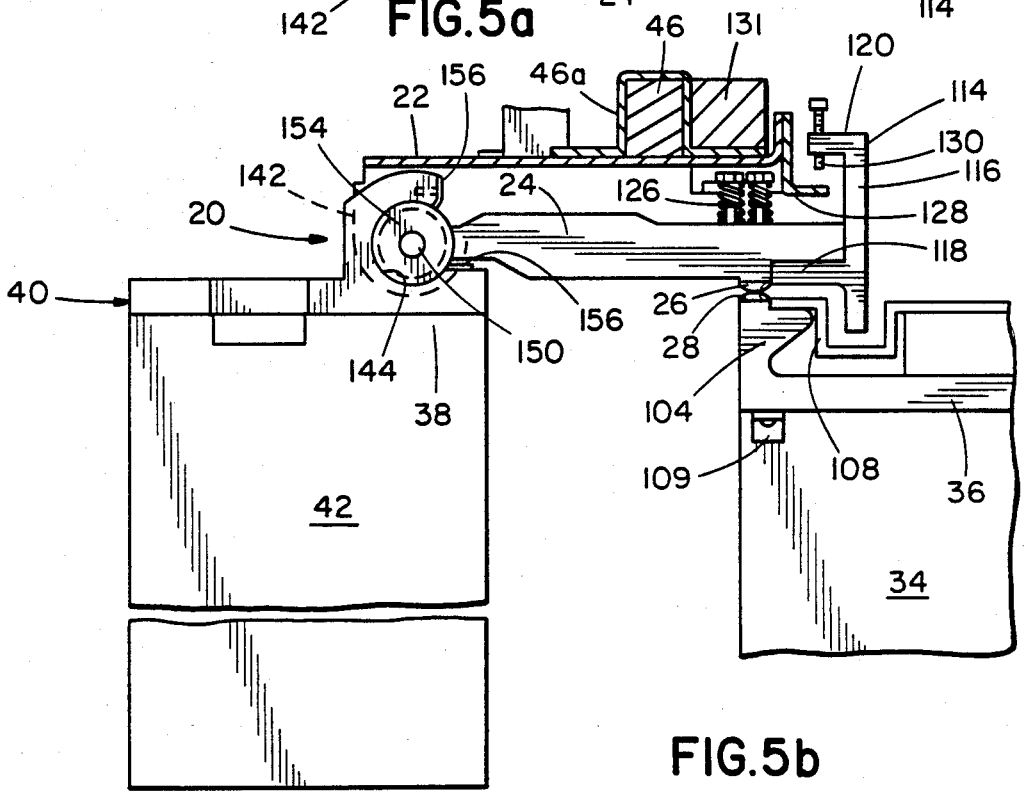
FIG. 5*b* is a side elevational view of the blades shown in FIG. 5 and illustrating a portion of associated carrier.

The blades 24 are of identical length to facilitate manufacture and the end portion of each blade overlapping the arc runner has a generally T-shaped steel horn or bar means 114 secured to the end thereof. Each horn 114 has a bar portion or crossbar 116 overlapping the blade end as also seen in FIGS. 5*a* and 5*b* with a downwardly extending portion of the crossbar received between the runner legs 108 and 110 of the runner 106 and relatively close to leg 108 when the contacts 26 and 28 are closed. Each horn 114 includes a leg 118 overlapped by the end portion of the respective blade 24 and spaced from the runner arm extending from leg 108 toward the respective contacts 28. Leg 118 extends to a position adjacent the respective contact 26 to protect the extending portion of the blade end and to aid in securing the horn thereto.

Another portion of the crossbar 116 extends to a position above the respective blade 24 and has a rearwardly extending leg 120, which overlaps but is spaced from the respective blade 24.

The arc suppressor assembly 113 comprises an arc stack of spaced arc suppressor plates 122 located between side insulating plates each having locating tabs for proper positioning in a respective breaker compartment adjacent the blade ends. The front edge of each plate 122 lies in a path close to the path of horn movement and a V-shaped notch 122*a* is formed in the edge of each plate facing the respective horns. Alternate plates 122 are positioned further from the blade ends than the other plates or staggered as shown in FIG. 2*a*. The arc stack thus forms a series of arc runner passages each positioned to pass the arc as the blades move in an upward arcuate path with the passages having exit openings that are wider or larger than the entrance openings and assist movement of the arc from the horns and dissipation of the arc gases through a plurality of vents 122*b*. Vents 122*b* are formed by a molded vent insulator member 123 placed in an opening located in the rear wall of the base 14 adjacent the ends of plates 122 as seen in FIG. 2.

The use of the molded insulator 123 is a very economical device for providing vents or openings of the proper size and spacing, since the vents do not have to be molded in the wall of the base, which would require mold inserts transverse to the mold cavity. Instead the vents 122*b* are molded into the insert or insulator 123 and the insulator simply inserted in the base opening.

Thus if a single large vent is provided not enough back pressure is created to extinguish the arc, while a small vent creates too much back pressure. It is desirable to provide a plurality of spaced vents 122*b* substantially $\frac{3}{4}''$ wide and $\frac{3}{8}''$ high aligned with respective ones of the arc runner passages defined by the spaced arc suppressor plates 122. Adjacent the lower end of the arc stack, this arrangement introduces enough vents during initiation of the arc when its pressure is high to prevent damage while the number of vents adjacent the top of the stack is smaller and are spaced apart by solid wall sections of greater height dimension than the vents to maintain a desired back pressure as the arc starts to extinguish. This type of venting arrangement for reasons mentioned is difficult and expensive to provide in the base wall and therefore the insulator 123 which is provided with a pair of side ribs 123*a* and a polarizing back wall 123*b* for engaging correspondingly shaped and dimensioned surfaces at the base opening is easily assembled in proper relationship to the stack and thereafter overlapped by the cover.

The blades 24 are pivotably supported adjacent their ends opposite horns 114 by pivot assembly 38 for pivoting movement about axis M as indicated by the schematic diagram in FIG. 5*e*. When the blades pivot about axis M to separate the contacts 26 and 28 the horn crossbar 116 travels relatively close to the arc runner leg 108, as the lowest end of the crossbar moves toward the radial line N extending from the pivot axis M to contact 26, while the contacts 26 and 28 separate by an ever increasing distance noted at X. The crossbar 116 between legs 108 and 110 of the arc runner thus moves along a path generally parallel to leg 108 which extends transverse to the radial line N. Therefore as the gap between the contacts 26 and 28 increases to the distance X, the gap distance Y between the bar 116 and leg 108 increases at a slower rate than the distance X and traverses the distance Z at which the horn 116 moves to a position adjacent side leg 110 of the arc runner.

The distance X therefore becomes rapidly greater than the distance Y and when the resistance in the arc increases to a value where the path between leg 108 and bar 116 offers less resistance, the arc transfers and extends between leg 108 and the horn bar 116. This occurs a short time after the contacts 26 and 28 open. As the blades 24 continue to pivot the horn bar 116, bar 116 approaches the distance Z, placing bar 116 close to leg 110 which also extends transverse to radial line N. The arc now transfers to the leg 110 and the current passes through the relatively high resistance steel arc runner plate 106. Thereafter as the horn bar 116 moves from between legs 108 and 110, the gap increases to increase the arc resistance and with the high resistance of the steel in the circuit, the arc is faciley extinguished. As often happens the arc may initially extend between bar 116 and leg 110. In either event the arc is quickly blown or magnetically forced to leg 110. The transfer of the arc to the steel runner 106 avoids damage or erosion of the contacts and protects the conductor 36 as the high resistance steel of the horn and runner are inserted in the circuit a relatively short time after the contacts open.

The carriers 22 for the blade assemblies 20 located in the side compartments of the breaker are attached to one end of opening springs 74 whose other ends are held by respective pins mounted on an insert member 124 adjacent the magnetic assemblies 78. When the latch link 62 is released by the latch assembly 66, the springs 74 pivot the carriers 22 in the breaker side compartments and the carrier **22*a* in the center compartment through crossbar 46 about axis M to initiate collapse of the toggle assembly 56. The carriers 22 are generally U-shaped and the back wall overlaps the respective blades and the pivot assembly 38, which is located between the side legs of each carrier 22 and 22*a* at the end of each carrier 22 and 22*a* opposite horns 114**.

A plurality of helical or coil overtravel springs 126 for each blade 24 are captured between each blade top surface and the back wall of the respective carrier 22 or **22*a*. Overtravel springs 126 bias the respective carrier 22 or 22*a* counterclockwise relative the blades 24 as seen in FIGS. 4, 5 and 5*b* to facilitate movement of the carrier and collapse of the toggle assembly 56 when the latch assembly 66 is released and their force requires that closing spring 70** supply considerable energy to close the contacts.

An L-shaped end adjustment leg or flange 128 is secured to each carrier 22 and **22*a* adjacent horns 114 and extends to a position between the ends of blades 24 and the upper legs 120 of the horns 114. Flanges 128 are engaged by an adjustment member screw 130 when the respective carrier is pivoted by the opening springs 74. The screws 130 are threaded through respective horn legs 120 to select the distance travelled by the carrier 22 or 22*a* before an opening force is applied to the respective blades 24 to rapidly open the respective contacts 26 and 28**.

Thus eleven blades 24 are usually provided in each breaker compartment to carry the current loads of the larger magnitudes described and the center group of blades in each compartment are provided with arc resistant contacts intended to carry arcing current while the outer blades carry low resistance contacts.

By adjusting the gap between screws 130 of the outer blades so that they are first engaged by the carrier 22 or **22*a* under normal overload conditions, their contacts open, while the contacts on the center blades are still closed. This avoids arcing between contacts 26 and 28 of the outer group of blades as the center group is still carrying the current. The blades in the center group then open their contacts, as carrier travel continues for engaging the respective screws 130. The blades in the center then open their contacts. At that time some arcing may occur before the arc transfers to the horn crossbars 116** as already explained, but this arc is minimal as the contacts of the center group need only separate approximately 0.1" before arc transfer occurs.

The inverted U-shaped member or bracket **46*a* is secured to each carrier back wall for securing the noncircular blade crossbar 46 interconnecting the blade assemblies 20 for simultaneous movement. The U-shaped member 46*a* on carriers 22 and an aluminum block 131 secured to the carriers 22 in the side compartments are adapted to be engaged by respective stop and shock absorber assemblies 132 carried by a wall of the cover 16 in the respective side compartments while a pair of short pins 133 secured to flanges on the back wall of carrier 22*a* in the center compartment are adapted to be engaged by a respective one of a pair of catcher assemblies 134, when the contacts 26 and 28** are opened in response to tripping of the breaker.

Shock & Catcher Assemblies

Figure 3A:
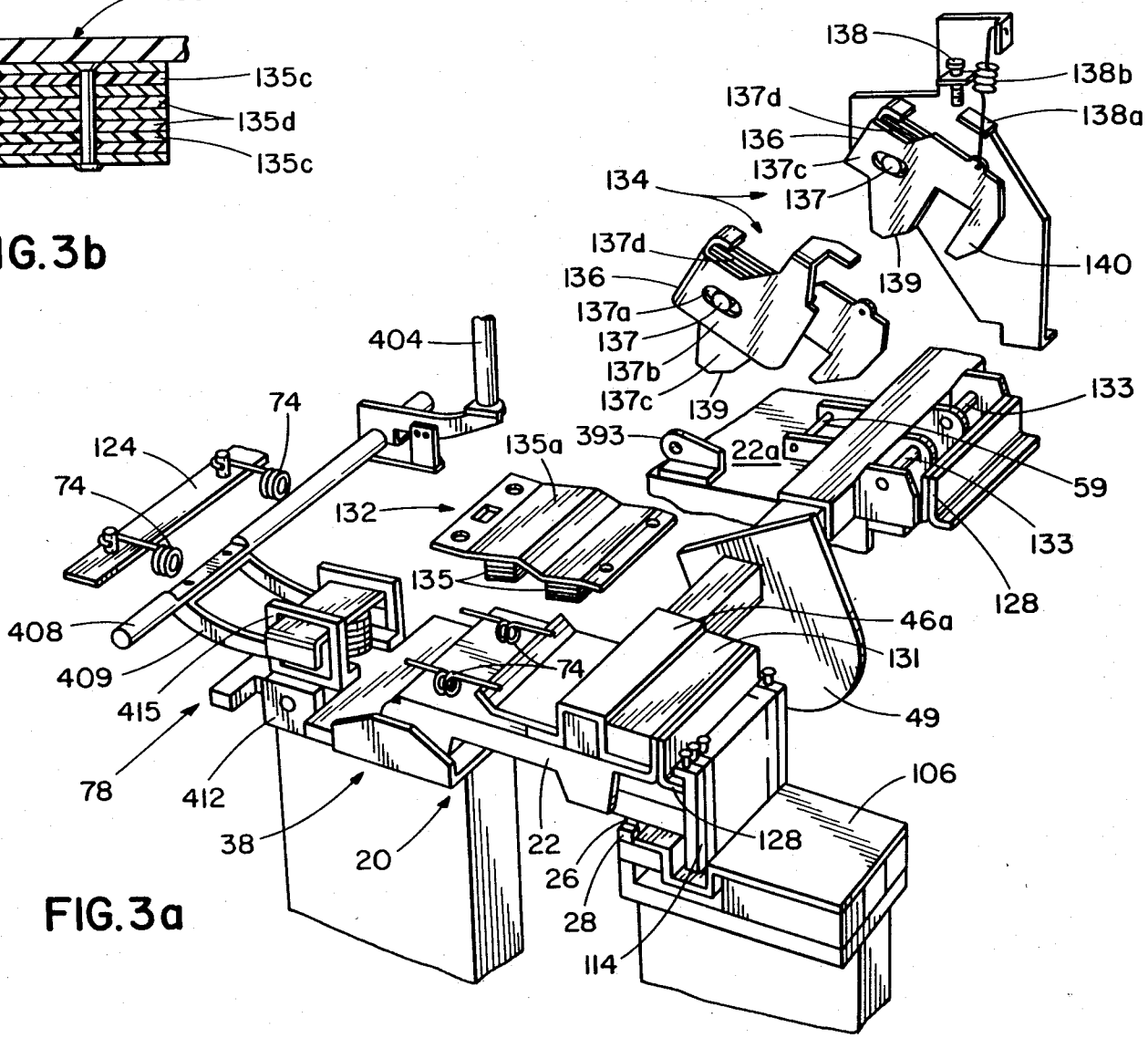
FIG. 3*a* is an exploded view illustrating the cooperation of the blade carriers with the stop shock and catcher assemblies.
Figure 3B:
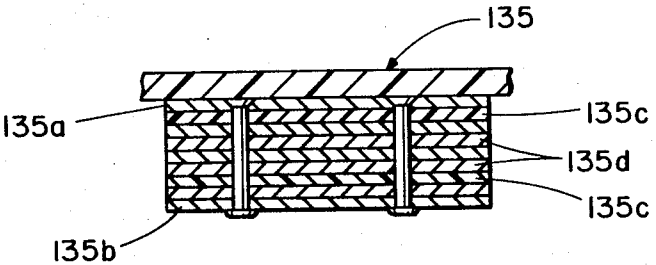
FIG. 3*b* is a sectional view of one of the stop shock assemblies.
Figure 3C:
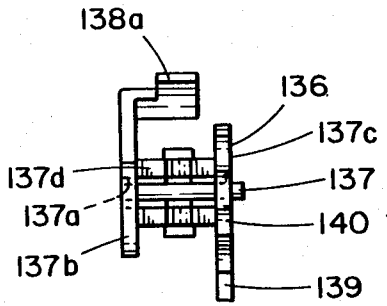
FIG. 3*c* is a front elevational view of one of the catcher assemblies.

Each assembly 132 comprises a pair of stacks or laminated stop plate assemblies 135 secured to and depending from a plate **135*a* as best seen in FIGS. 3*a* and 3*b*. Plate 135*a* in turn is secured to the cover by end flanges which extend beyond assemblies 135 and plate 135*a* is provided with angled portions or offsets mating with a corresponding configuration of the cover. The lower surface of each assembly 135 is thus placed in a respective plane for engaging bracket 46*a* and block 131 respectively along a respective planar surface during the arcuate movement of the respective carrier as seen in FIG. 4*d***.

Each plate assembly 135 comprises a respective stop plate **135*b* first engaged by the member 46*a* and block 131 together with a pair of respective plates 135*c* formed of plastic material preferably a thermoplastic polyester elastomer of 63D durometer hardness sold by Dupont under the name Hytrel. The plates 135*c* are substantially 0.079" thick and are spaced apart by a plurality of respective steel separator plates 135*d* to form a solid stop assembly with shock absorbing qualities and of relatively large area since advantage is taken of the space on the cover above the carriers. The plates 135*b*, 135*c* and 135*d* are substantially $3\frac{1}{2}$" long and almost $\frac{3}{4}$" wide to provide a large area for each of the four assemblies 135** and in turn enhance the distribution of forces on the assemblies.

The catcher assemblies 134 each comprise a right or left hand U-shaped steel member or catcher 136 pivotally supported by a respective pin 137. Each pin 137 extends toward each other from a respective portion of each outside frame wall 52 projecting past the frame front wall 54 in the breaker center compartment. Each pin 137 passes through a slot **137*a* in each side leg 137*b* and 137*c* of the respective member 136 and also extends through widened recesses in a plurality of shock absorber members 137*d* formed of neoprene rubber or the like and held between respective legs 137*b* and 137*c* to provide shock absorbing movement of the members 136 transverse to the axis of pin 137. Members 137*d* are located adjacent the back wall of member 136** where they are also captured between upper and lower flanges on the back wall.

The outer side walls 52 of the frame 50 also carry a flange through which an adjustment screw 138 extends to engage an edge of a stop **138*a* projecting upwardly from each leg 137*b* and toward the respective leg 137*c***.

The stop 138*a* is engaged by screw 138 at a position located on the same side of pin 137 as the pins 133 so that the stop and catchers 136 may pivot clockwise from screw 138. A spring 138*b* extending from a flange on a respective wall 52 to leg 137*a* serves to bias each member 136 counterclockwise as seen in FIG. 3*a* against a respective stop or screw 138, which is adjusted so that angled surface 139 on each hook member leg 137*c* is engaged by bracket 46*a* only after plate assemblies 135 have been subject to compression.

Thus in response to rapid opening of the contacts 26 and 28 due to short circuit conditions, for example, the top surface of bracket 46*a* engages surface 139 on a depending portion of each leg 137*c* to pivot each member 136 rapidly clockwise against the bias of spring 138*b*. This engagement between bracket 46*a* and surface 139 occurs after engagement of plates 135*b* as illustrated in FIG. 4*d* and some compression of stacks 135. A hook 140 depending from each leg 137*c* and normally clearing respective pin 133 by about 0.06" during upward movement of the pins then passes between a respective pin 133 and the carrier 22*a* since the hooks 140 are further from pin 137 then surfaces 139 and therefore travel further. The hooks 140 are then positioned to intercept the pins 133. In the event the carriers 22 struck respective stops 135 with sufficient force to cause rebound of the carriers 22 and 22*a*, the pins 133 being intercepted and engaged by hooks 140 are prevented from rebounding sufficiently to reclose the contacts and give rise to additional arcing, while the shock absorber members 137*d* engage against pins 137 to absorb the rebound shock as the catcher members 136 move transversely of pins 137 in response to the rebound force. When the excess energy of the opening or rebound force dissipates, the opening springs 74 serve to again bias bracket 46*a* toward surface portion 139, while the members 46*a* and 131 come to rest against respective plates 135*b* of stop assemblies 135.

Under normal or rest engagement against stacks 135, the bracket 46*a* does not engage surfaces 139. Hooks 140 are not then positioned to engage pins 133 due to the bias of springs 138*b* so that the hooks 140 do not interfere with normal closure of contacts 26 and 28, after bracket 46*a* and blocks 131 come to rest.

Blade Pivot Assembly

Figure 5C:
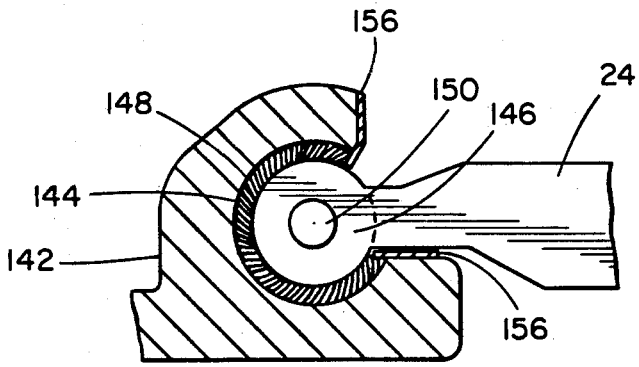
FIG. 5*c* is a sectional view taken generally along the line 5*c*—5*c* in FIG. 5*a* to more clearly illustrate the pivot assembly.

Each pivot assembly 38 located between the side legs of the respective carrier 22 and 22*a* comprises an arcuate bearing boss 142 located adjacent one end of the load conductor 40 and having an arcuate recessed bearing surface 144 extending over 180° to receive an arcuate or circularly shaped boss 146 at the end of each blade 24 opposite the horns 114 as best seen in FIGS. 5*b*, 5*c* and 5*d*.

Boss 146 has a somewhat smaller diameter than surface 144 and may be out of round by as much as 0.006". A pair of helical diameter coil springs 148 having an outer diameter of substantially 0.120" formed of 0.016" diameter silver plated copper cadmium alloy wire having a conductivity of 85% of pure copper and resilient at a continuous temperature 130° C. are interposed between each blade circular boss 146 and the arcuate or circular bearing surface 144 and accommodate any eccentricity of the blade bosses.

The difference in the diameter between the blade circular boss 146 and the arcuate bearing surface 144 is smaller than the outer diameter or OD of the springs 148 and is chosen so that each spring turn lies at angle of substantially 45° to the longitudinal axis of the spring with the longitudinal axis extending parallel to the arcuate surface of the blade boss 146. The chosen angle is a function of the difference in diameter between the surface 142 and bosses 146 and the spring diameter and serves to accommodate the eccentricity of the blade bosses without binding. Thus wrapping the springs 148 about each blade boss 146 provides multiple points of electrical contact between each blade 24 and the conductor 40 through the bearing boss 142. In addition the springs 148 are coated with a silicone grease sold by General Electric under the name Versalube G341 M. It will be noted that the spring turns of each pair of springs 148 engaged with any one boss 146 extend in transverse directions or at 90° to each other as seen in FIG. 5*a* so that the effect of pivoting movement by the boss in any one direction is compensated.

A rod 150 extends through an aligned aperture 152 in each circular boss 146 and an aligned aperture in a plurality of spaced washers 154 each located between respective blade bosses 146. The washers 154 each have a diameter larger than the respective blade boss 146 and serve to restrain axial movement of the springs 148. A respective sheet metal retaining member 156 is fastened to the bearing boss 142 adjacent each end of surface 144 and each member 156 has an edge projecting past the respective end of surface 144 to restrain circular movement of the springs about the pivot axis M formed by rod 150, which primarily carries the weight of the blades.

In addition a portion of the circumference of the washers 154 is notched to provide spaced shoulders engaging each restraint member 156 and the bearing boss 142 is slightly deformed at opposite ends to restrain axial movement of the washers, springs and blades. The rod 150 forms the pivot axis M for the carriers 22 and 22*a* and end walls or brackets 158 on conductor 40 traps the rod which carries the weight of the blade bosses. Thus the pivot assembly 38 presents an economical arrangement for carrying high electrical currents around a pivot connection, since the blade bosses 146 together with springs 148 may easily be inserted axially in boss 142 with the washers 154 between adjacent springs 148. Thereafter the blades 24 and springs 148 are supported in the boss 142 with the springs providing multiple points of electrical conductivity to minimize heat rise in the breaker and aid in maintaining high current withstand of the breaker.

Since the opening of the contacts 26 and 28 by engagement of carrier flange 128 with screws 130 during overload conditions occurs with minimum frictional loads, movement is initiated relatively easily as minimum back pressure is applied to resist springs 126, and in the event of short circuit currents, when opening forces are high, movement of all blades will occur substantially simultaneously with engagement of the flange 128 by the respective screws 130.

Charge and Crank Assembly

In order to supply sufficient energy to close the contacts 26 and 28 against the pressure of springs 74 and 126, the helical charging spring 70 must be of substantial size and one end must be moved a substantial distance. Therefore to tension the spring 70 requires considerable force which is supplied by the charge and crank assembly 68.

One end of spring 70 is anchored to a fixed pin 160 extending between the intermediate walls 53 of the frame 50. The other end of spring 70 is secured to a pin 162 carried between the arms of a U-shaped crank 164 in the charge and crank assembly 68 for movement along an arc described by pin 162 as the crank 164 is rotated about the axis of a pivot pin or shaft 166 supported by the walls 52 of frame 50 below a respective portion of walls 53.

Pin 61 pivotally interconnects the upper toggle links 60 with the lower toggle link 58. Pin 61 is adapted to slide in a slot 170 formed in each of a pair of follower arms 172 pivotally supported by a respective pin 174 on a respective side leg 176 of the crank 164.

Figure 4A:
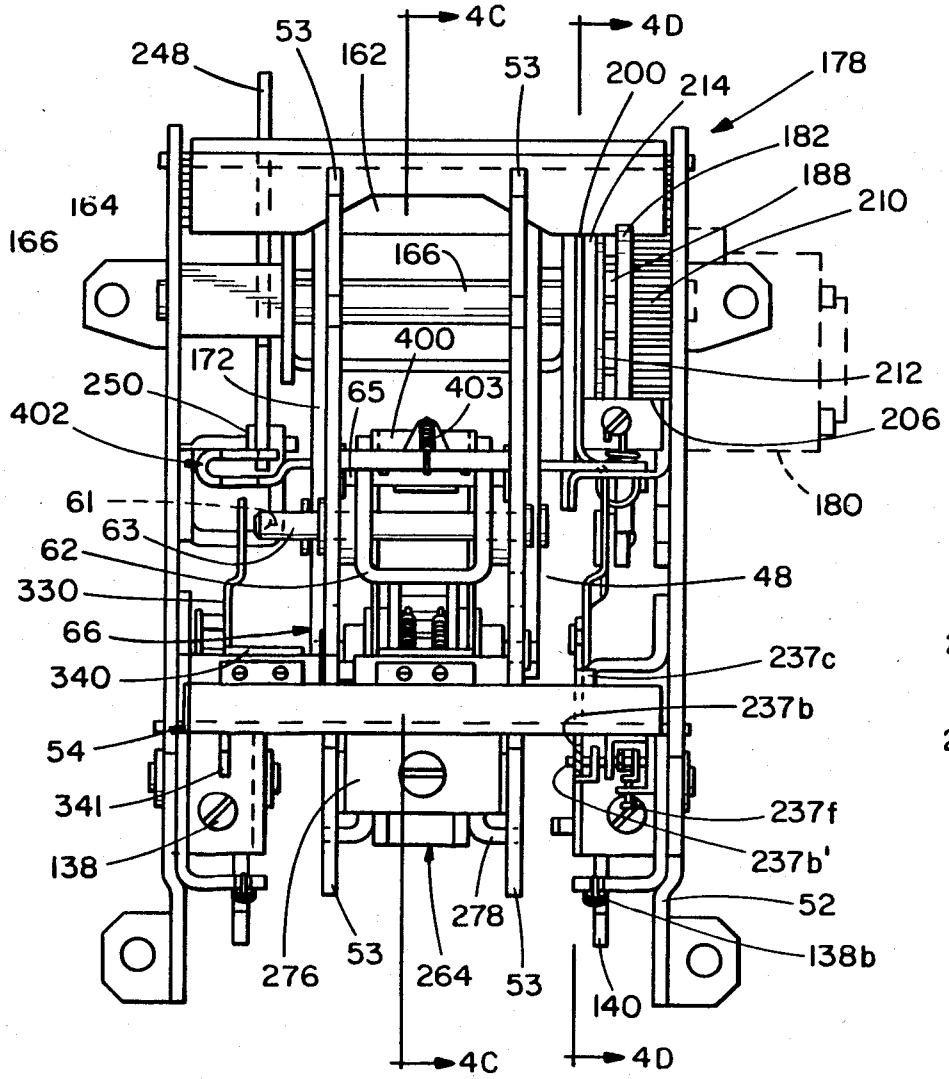
FIG. 4*a* is a top elevational view of the operating and charge assemblies with the trip solenoid and interlock assemblies omitted.
Figure 4C:
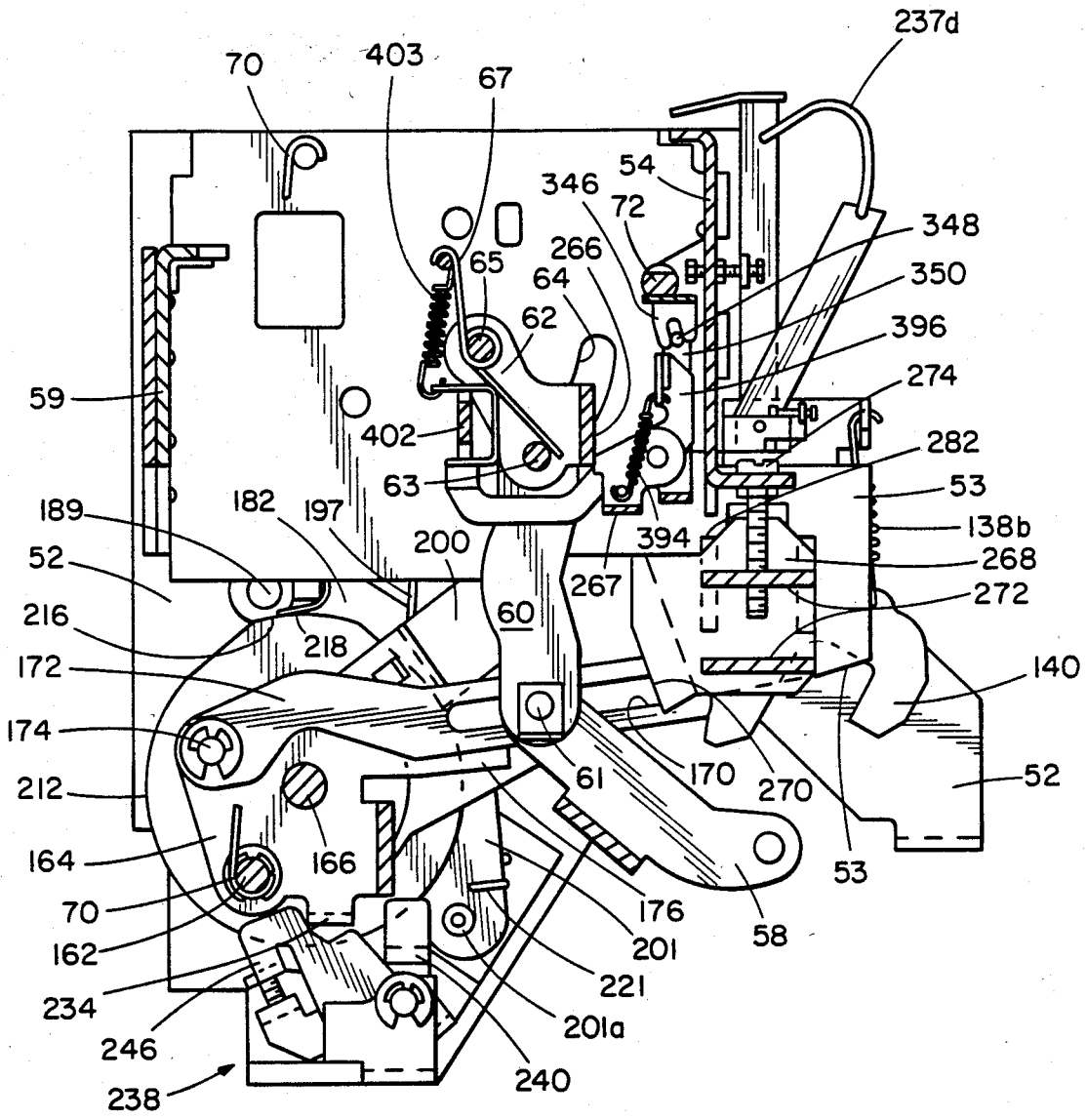
FIG. 4*c* is a sectional view of the assemblies shown in FIG. 4*a* taken generally along the line 4*c*—4*c* in FIG. 4*a*.
Figure 4D:
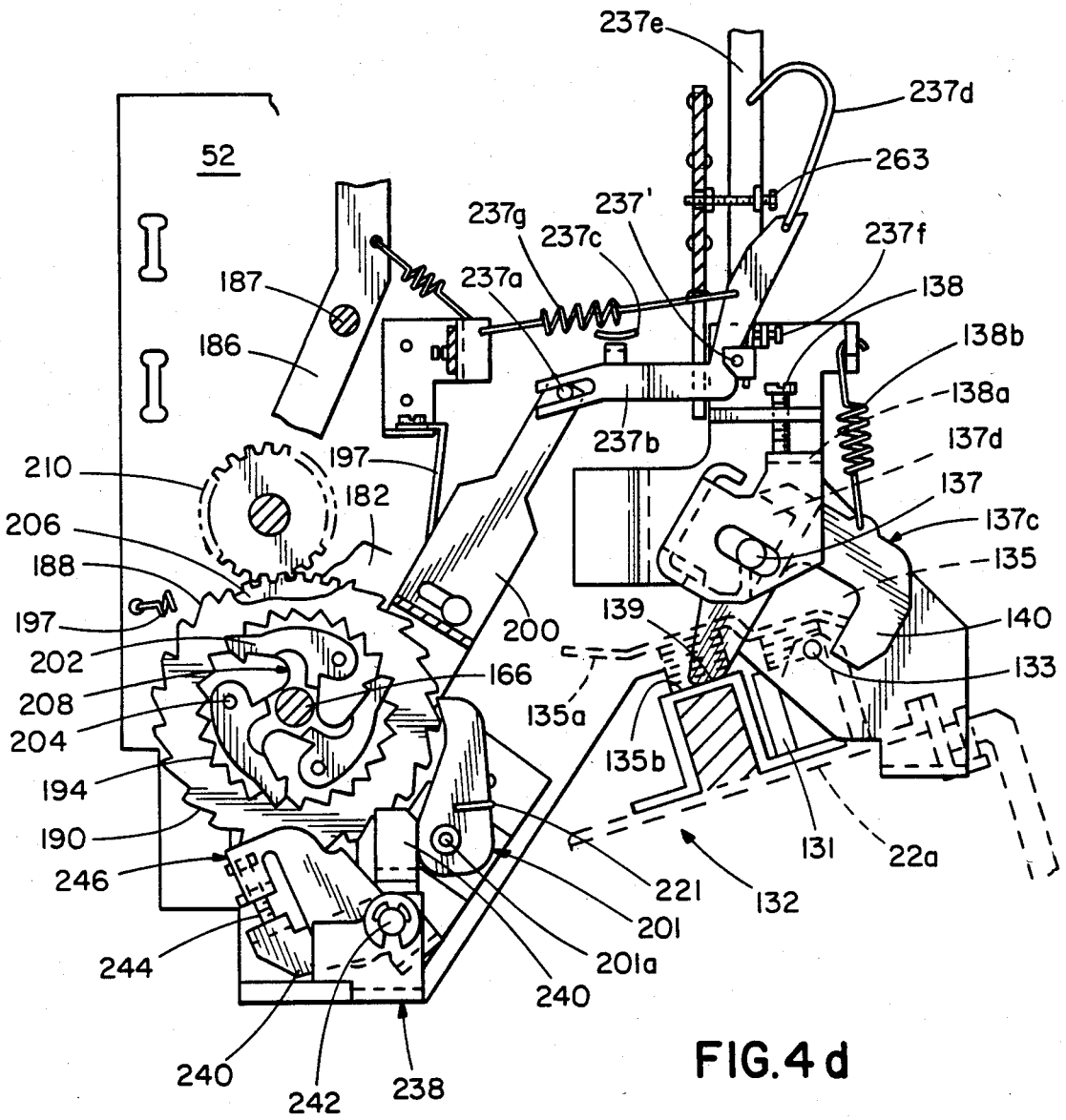
FIG. 4*d* is a sectional view taken generally along the line 4*d*—4*d* in FIG. 4*a* and also illustrating the operation of the stop shock and catcher assemblies.
Figure 4G:
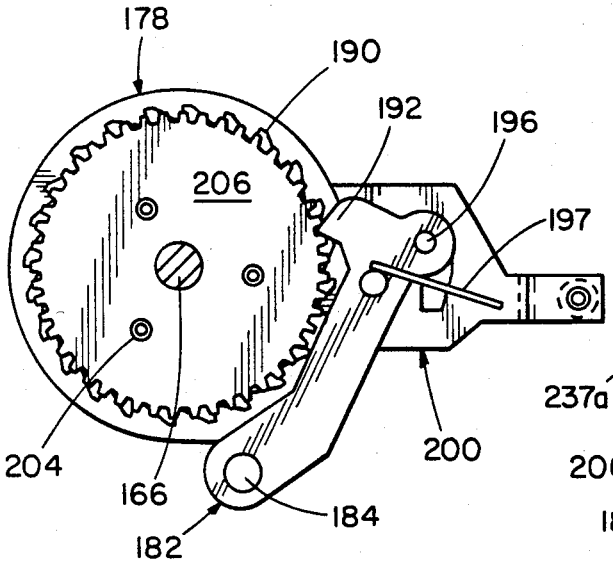
FIGS. 4*e*—4*i* are respective elevational and sectional views of the charge and crank assembly.
Figure 4E:
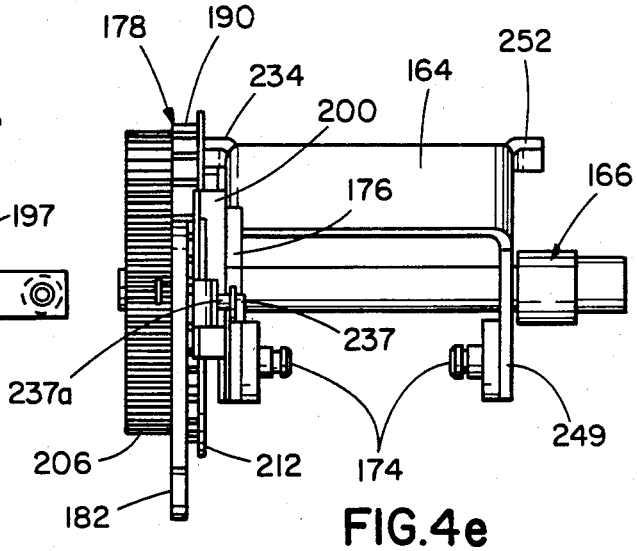
Figure 4H:
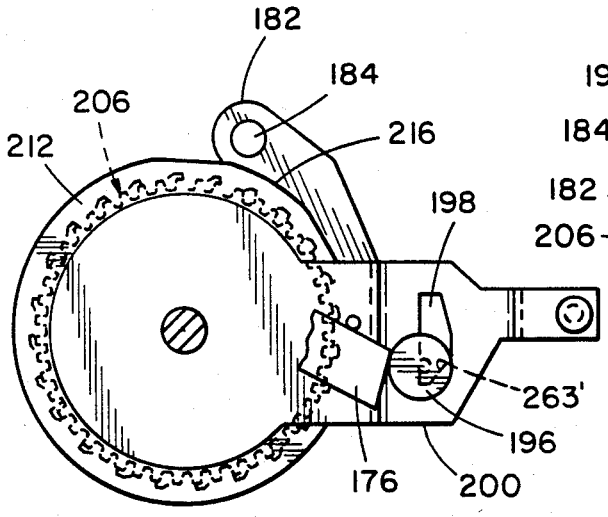
Figure 4F:
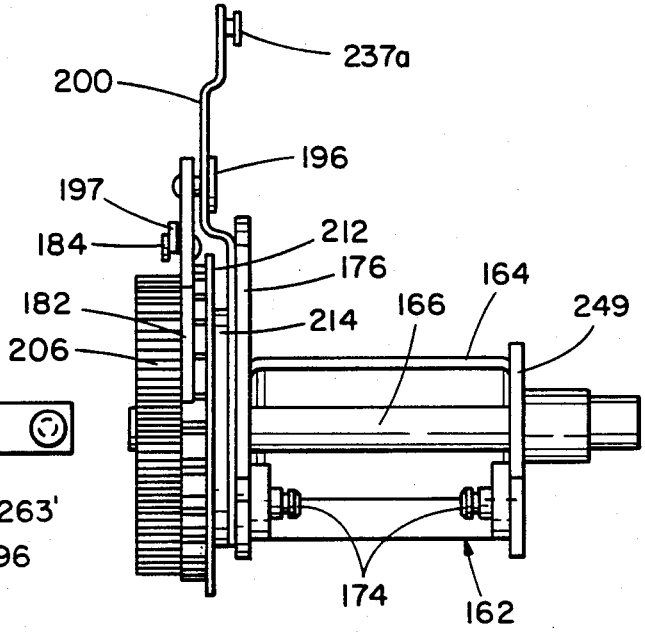

The crank 164 is rotated by a ratchet assembly 178, as seen in FIGS. 4*a*, 4*b* and 4*d*–4*h*, of the charge and crank assembly 68 under control of electrically operable means or a motor 180 in one breaker side compartment as indicated in FIGS. 2 or 4*a*. The ratchet assembly is also under control of a ratchet operating handle crank or pull link 182 pivotally connected at one end by pin 184 to a manually operable means or handle link 186. Handle link 186 in turn is pivotally supported in frame compartment 55*a* between one wall 52 and the adjacent wall 53 of the frame 50 by a pin 187 for reciprocating movement between a pair of spaced stops located in the cover and is manually controlled by spring charging handle 98.

Figure 4I:
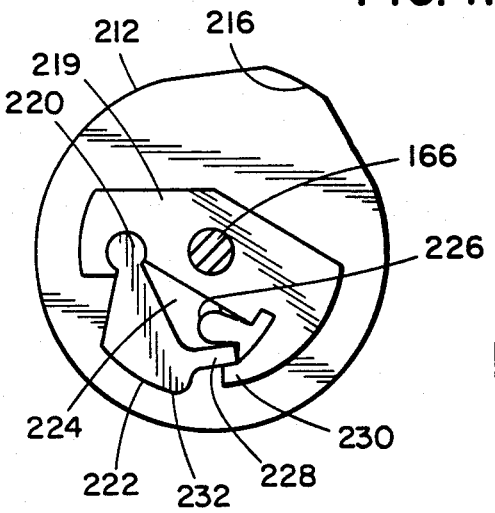
Figure 4J:
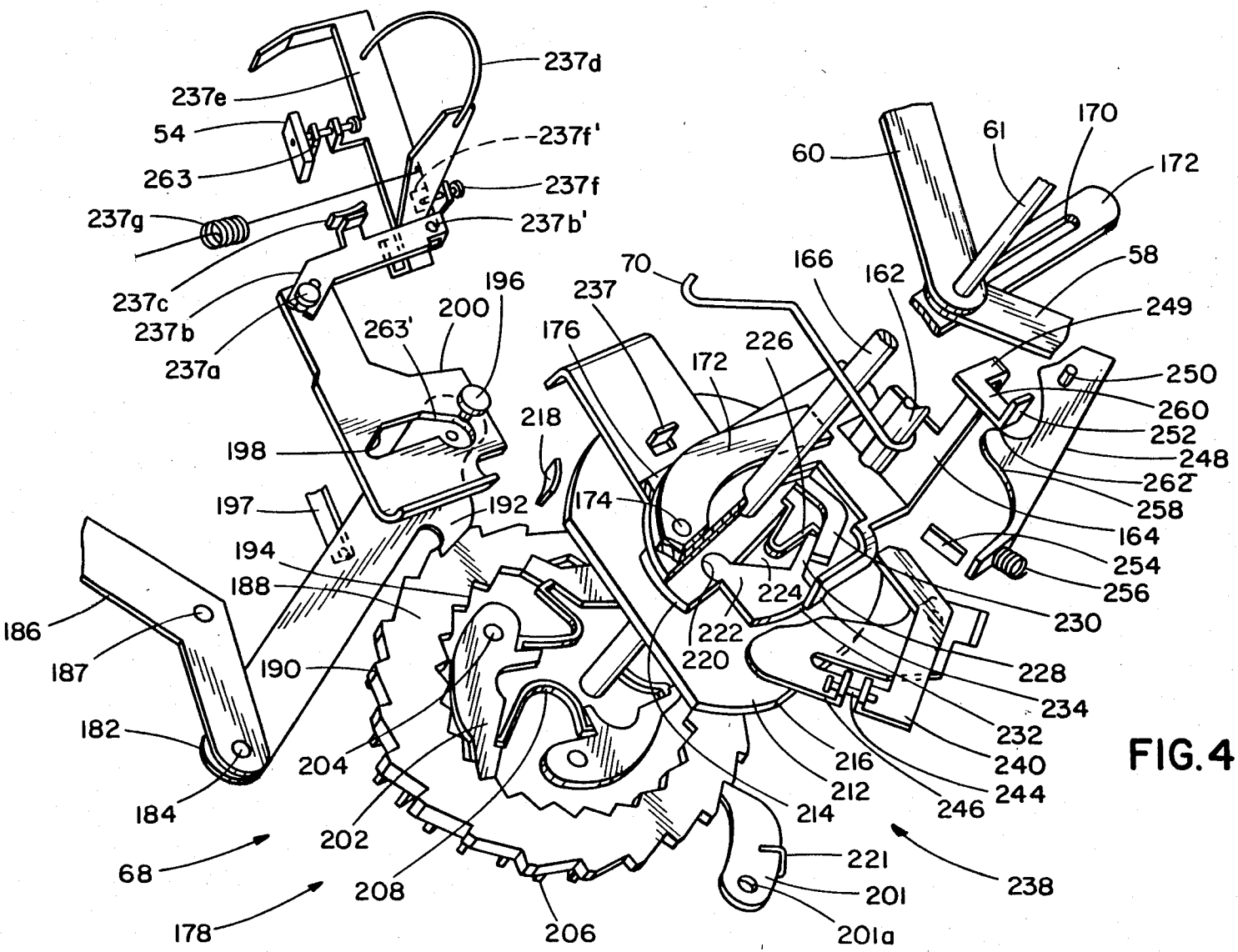
FIG. 4*j* is an exploded view of the charge and crank assembly.

The ratchet assembly 178 comprises an annular ratchet 188 best seen in FIGS. 4*d* and 4*j* having outer circumferential teeth 190 each including a radial surface adapted to be engaged by a pawl 192 on pull link 182. Ratchet 188 is also provided with beveled inner circumferential teeth 194 located radially inwardly of teeth 190.

The pull link 182 is provided with a pin 196 having an enlarged head and located at the end of link 182 opposite pin 184. A spring 197 engaging link 182 biases the pawl against each radial surface of teeth 190 in sequence. Pin 196 extends through a slot 198 in a handle lock or positioner 200 having an offset portion pivotally supported on shaft 166 adjacent one side leg 176 of crank 164. During pivoting of link 186 in a counterclockwise direction as seen in the drawings the ratchet is advanced. During each clockwise reciprocation of pawl 192 to engage a succeeding tooth 190, the ratchet 188 is held by a stop pawl 201 pivotally supported in compartment 55*a* between walls 52 and 53 by a pin 201*a*.

Teeth 194 are adapted to be engaged by three pawls 202. Pawls 202 are each pivotally supported by a respective cantilever pin 204 extending from a gear 206 and each is biased into engagement with beveled teeth 194 by a respective generally U-shaped leaf spring 208 for driving ratchet 188 when the gear 206 is rotated in a counterclockwise direction.

The driven and rear surfaces of each tooth 194 extend somewhat transverse to a respective radial line of the ratchet 188 and engage correspondingly angled surfaces on the pawls 202 for enabling the pawls 202 to respectively drive the ratchet and to be rotated radially inwardly of the ratchet about their axis at pins 204 and against the bias of springs 208. The pawls 202 can therefore ride or pass over the teeth 194 when the ratchet is operated by pawl 192 independently of gear 206 and the motor 180.

The end legs of the springs 208 are captured between generally parallel surfaces on adjacent pawls 202. This ensures proper retention of the springs when a radially inwardly directed force is exerted against the springs 208 in response to operation of the ratchet 188 by pawl 192 and both ends of each spring serve to bias the respective pawls in opposite directions for engagement with the ratchet teeth.

Gear 206 is located adjacent one face of ratchet 188. Gear 206 is adapted to be driven through a gear 210 from a shaft extending through frame wall 53 to an electrically operated gear reduction motor or ratchet operating means 180 secured to the adjacent frame wall. The motor 180 is located in a respective side compartment of the breaker and above a respective magnetic respective assembly 78.

At the face opposite gear 206, ratchet 188 is fixed to a cam member 212 which rotates with ratchet 188 about the axis of shaft 166. Cam member 212 has a radially greater periphery than the ratchet 188 and at the face opposite ratchet 188 and adjacent the offset portion of handle lock 200 an axially thickened wall portion 214 is formed on the cam 212 as for example seen in FIGS. 4*f*, 4*i* and 4*j*.

A radial projection 216 on the cam or member 212 is adapted to engage a switch arm 218 of a microswitch when the cam 212 and ratchet 188 reach their home position and spring 70 is charged to deenergize the motor 180 as will be explained.

The periphery of axially thickened wall portion 214 is spaced radially inwardly of the circumferential portion of cam 212. Portion 214 has a socket 220 formed therein extending over 180° for journalling one end of a clutch or pusher 222.

The clutch 222 is located in a recess 224 formed in the thickened wall portion 214. A generally U-shaped leaf spring 226 captured between one surface of recess 224 and an end leg 228 of pusher 222 biases pusher 222 clockwise about its axis in socket 220 as seen in FIGS. 4*i* and 4*j* to bring leg 228 against a stop wall 230 of the recess 224 with a flat surface or pusher portion 232 of pusher 214 located radially outwardly of the periphery of wall portion 214.

Surface portion 232 is then located to engage a tab 234 extending axially from the adjacent side arm 176 of crank 164. Engagement occurs along a radial line extending from the axis of socket 220 so that rotation of ratchet 188 and portion 214 applies a force to rotate the crank 164 counterclockwise as seen in FIGS. 4, 4*c* and 4*j*. As mentioned the charging spring 70 has one end connected to a fixed pin 160 carried by the frame 50 and a second end connected to pin 162. Pin 162 extends between the side arms of crank 164 at a position behind surface 234 during counterclockwise rotation. Thus rotation of ratchet 188 by either gear 206 or pawl 192 rotates cam 212 together with pusher 222 to rotate the crank 164 against the tension of spring 70, while the force generated by tensioning closing spring 70 on surface 232 is transmitted to the thick wall portion 214 through the pusher 222.

Figure 8B:
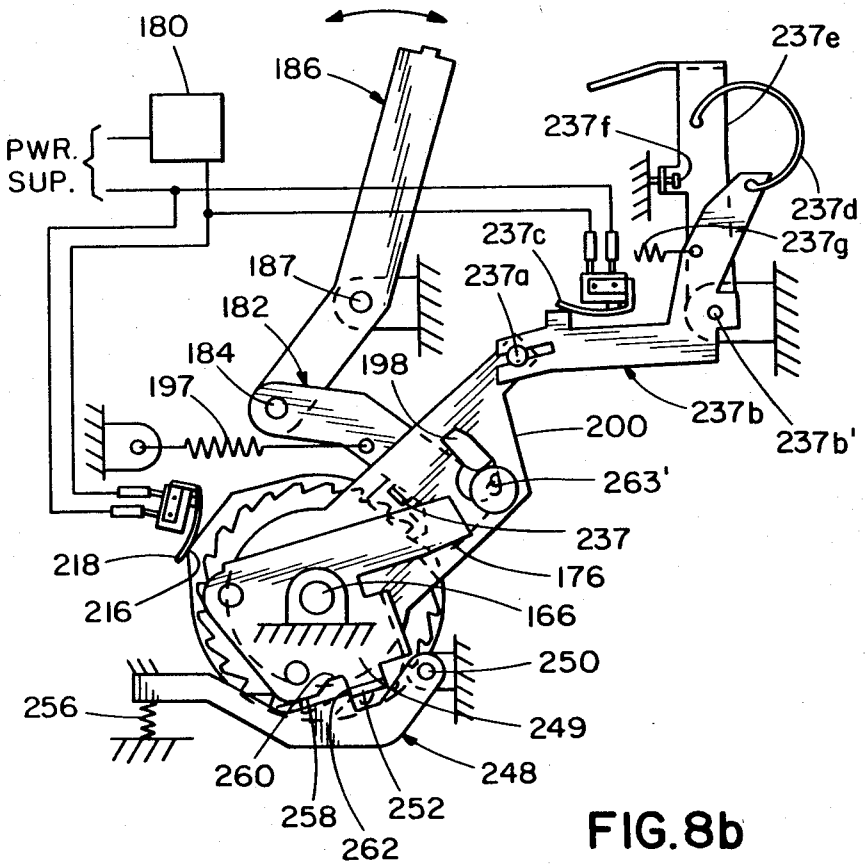
FIGS. 8, 8*a* and 8*b* are schematic views illustrating the operation of the charge and crank assembly.
Figure 8A:
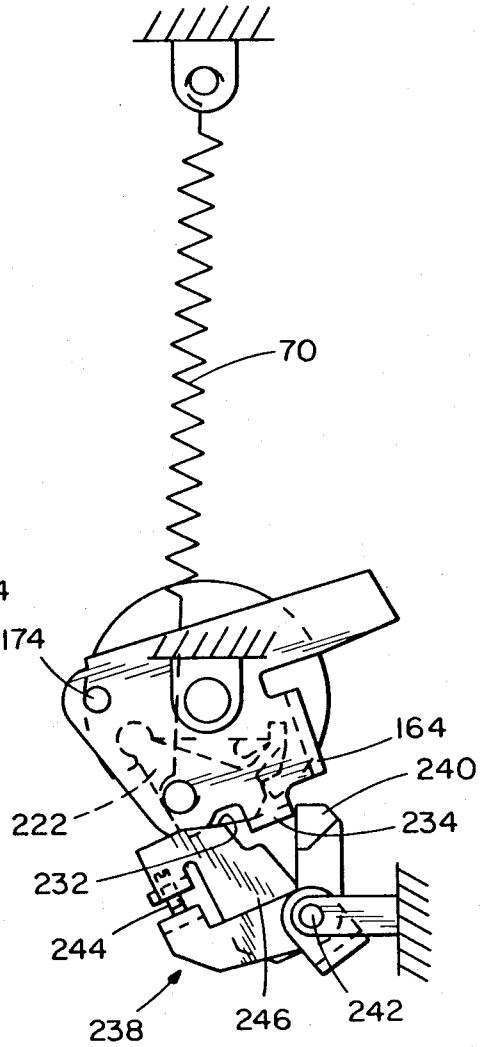
Figure 8:
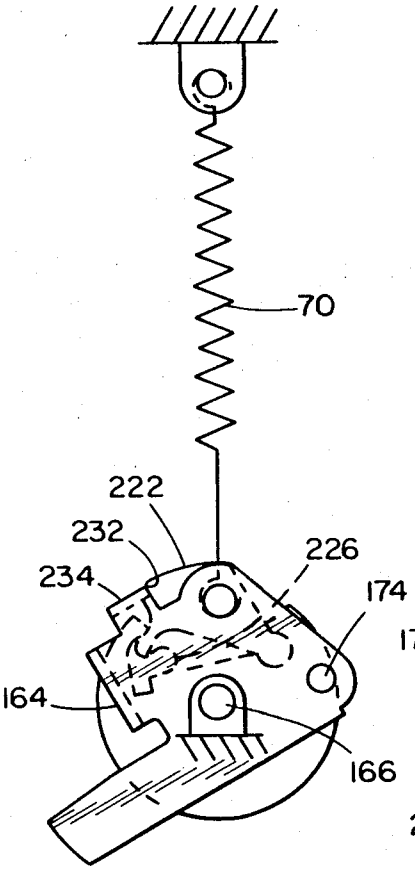

During counterclockwise rotation of the crank 164, the pin 162 is rotated from a position adjacent top dead center shown schematically in FIG. 8, in which spring 70 is substantially discharged to a position below and to the left of pin 166 as seen in FIGS. 4*c*, 4*j* and 8*a* where only a small torque is exerted by the spring on the crank. This movement brings the corresponding end of spring 70 from a position above the axis of shaft 166 to a position below the axis of shaft 166 or through substantially 170° of arc while the spring 70 is stretched substantially 2". Stop pawl 201 in the meantime simply rides successively over the circumferentially extending surface of each tooth 190 against the bias of torsion spring 221. The surface 232 of drive member or clutch 222 must then be disconnected from the crank tab 234 to stop further tensing of spring 70 or to prevent spring 70 from engaging pin 166.

Just before the pusher 222 is disengaged from tab 234, the crank arm 176 engages a tab 237 extending from the handle lock or positioner 200 as shown in FIG. 4*j* or schematically in FIG. 8*b* to pivot the positioner 200 counterclockwise about the axis of pin 166.

Positioner 200 acting through a pin 237*a* is engaged in a slot in one end of an L-shaped lever 237*b*. Lever 237*b* extends through a slot in the front wall 54 of the frame and is pivotally mounted by pin 237*b'* supported on a bracket adjacent the frame front wall 54 and extending through a U-shaped tab adjacent the juncture of the lever legs. One leg of the lever extends upwardly adjacent the front wall 54. A tab on the leg of lever 237*b* operated by lock 200 engages a lever arm 237*c* of a microswitch to open one circuit to motor 180 as indicated in FIG. 8*b*. The upwardly extending other leg arm of lever 237*b* is interconnected by a wire spring 237*d* to a label arm 237*e* having a U-shaped tab at its bottom end pivotally mounted on the same pin 237*b'* as lever 237*b*.

As the lever 237*b* moves clockwise under the force of the positioner 200 and against the bias of a spring 237*g*, the label arm 237*e* snaps clockwise under the influence of spring 237*d* to the position controlled by an adjustment stop screw 237*f* extending through a rear tab on the support bracket to a tab 237*f'* on the label arm to provide an indication at indicator 96 that the spring 70 is charged.

To disengage the drive member or pusher 222 from the crank tab 234 a trip assembly or disconnect means 238 is employed. Trip assembly 238 includes an L-shaped trip arm or lever means 240 pivotally supported by a pin 242 at the leg juncture and supported by a bracket mounted on an adjacent frame wall 52. One leg of trip arm 240 is adapted to be engaged by the leading edge of tab 234 when the spring 70 is substantially fully charged. The other leg of trip arm 270 has a threaded flange extending therefrom to receive an adjustment screw 244 extending through a similar L-shaped flange on a trip cam 246 also pivotally supported on the pin 242. Trip arm 240 thus in turn rotates trip cam 246 clockwise as seen in FIGS. 4, 4*d*, 4*j* and 8*a* through adjustment screw 244.

The pin 242 is located forwardly of pin 166 in the direction of movement of tab 236, while cam 246 is longer than the leg of arm 240 engaged by tab 234 so that the end of cam 246 moves a greater distance than the engaged leg of trip arm 240 or the pusher 222 and transverse to a radial line from socket 220 to surface 232 to engage the pusher 222.

Cam 246 therefore engages the surface of pusher 222 behind surface 232 and additional movement of tab 234 and trip arm 240 together with cam 246 pivots the pusher 222 about the axis in socket 222 to move the pusher radially inwardly of pin 166 against the bias of spring 228. This movement also moves surface 232 radially inwardly of the crank tab 234 and disengages the pusher 222 from the tab 234 and the crank 164.

As the torque executed by spring 70 in its fully extended position on the crank is relatively small due to the short moment arm, a relatively small, low power, space saving motor 180 can be used to tense spring 70 and also have sufficient power to operate the assembly 238 for disengaging the pusher.

Thereafter the ratchet 188 together with the pusher 222 may continue to rotate, as the motor 180 remains energized through a circuit controlled by lever arm 218 and its associated microswitch which is connected in parallel with the circuit controlled by lever 237*c*. The pusher 222 therefore continues to ride over the radially inward surface of the tab 234, while the crank 164 is held from backward or clockwise rotation under the influence of spring 70 by a retaining means or closing latch 248.

After pusher 222 disengages from tab 234 the pusher 222 returns to its radially outward position under the influence of spring 226 while the trip assembly 238 remains in its operated position until the spring 70 is discharged. At that time the crank 164 returns and engages trip cam 246 to return the assembly 238 to its normal or unoperated position.

It will be appreciated of course that the adjustment of screw 244 controls the position and angle at which cam 246 engages the pusher 222 and therefore ensures that the pusher 222 is disengaged from the tab 234 at the time spring 70 is properly tensed and both before spring 70 engages pin 166 and after the latch 248 retains the crank to avoid problems inherent in manufacturing tolerances. In the meantime arm 218 being disengaged from cam projection 216 maintains the motor 180 energized and the ratchet 180 together with the pusher 224 are advanced toward their home or normal position under the influence of pawls 202 while the crank 164 and label arm 237*e* remain in the charged position with spring 70 fully charged.

The closing latch 248 is an elongate member pivotally supported by means of a pin 250 on a U-shaped bracket secured in compartment 55*b* of the frame 50. Latch 248 is located adjacent the side arm 249 of crank 164 opposite arm 176 and the tab 234. The side arm 249 of crank 164 has an axially extending tab 252 for engagement by the closing latch 248. Tab 252 is circumferentially generally aligned with tab 234 but is of somewhat shorter circumferential extent and the back edge of tab 252 leads the back edge of tab 234 slightly.

The closing latch 248 extends to a position beneath a push to close link or spring discharge means 254 operated by push to close button 92 on the cover panel for discharging spring 70 to close the contacts 26 and 28. A spring 256 located between a wall of the base 14 and the end of the latch 248 opposite pin 250 biases latch 248 clockwise about pin 250 so that a cam surface 258 of the latch 248 is adapted to ride or engage the periphery of the side arm 249 of crank 164. A spring 259 biases the push to close link 254 from the end of the closing latch 248.

During rotation of the crank 164, the cam surface 258 is engaged by the periphery of the respective side arm 249 of crank 164. The closing latch 248 rotates slightly counterclockwise as the juncture of the side arm and the back leg of the crank passes thereover and also as the latch engages the leading edge of tab 252 formed on the respective side arm 249 of the crank. As mentioned the back edge of the tab 252 is located in a circumferential position slightly ahead of the back edge of tab 234. A notch 260 is formed directly behind the tab 252, while the closing latch 248 has a locking radial surface 262 formed directly behind the cam surface 258.

When the notch 260 is aligned with the locking surface 262 the cam surface 258 moves into the notch 260 under the influence of the spring 256. The locking radial surface 262 engages the tab 252 along a radial line from the pin 250 to thereby resist the force of spring 70 applied for rotating the crank clockwise about the axis of pin 166. As mentioned adjustment of screw 244 ensures that latch 248 retains the crank before the pusher 222 is disengaged from tab 234. The spring 70 therefore remains in the charged position until the crank 164 is released by the push to close button 92. The rear edge of tab 252 is of course located so that engagement with surface 262 occurs just before the pusher 222 is disengaged from tab 234.

The link 254 secured at one end to the push to close button 92 and is suitably guided on the rear end wall 54 of the frame 50 by a pair of guide pins. When button 92 is depressed against the bias of spring 259, link 254 engages the adjacent end portion of closing latch 248 for pivoting the latch 248 against the bias of spring 256 to disengage surface 262 from notch 260 and thereby permit rotation of the crank 164 by spring 70. However, unless the contacts 26 and 28 are for example held tripped or open, operation of link 254 is prevented by interlock assembly 94 as will be explained, since discharge of spring 70 against the closed contacts may damage the apparatus.

After the pusher 222 has disengaged from crank 164 rotation of the gear 206 by the motor 180 continues to rotate the ratchet 188, since arm 218 maintains one circuit completed to motor 180 in parallel with the now open circuit disrupted by arm 237*c*. When cam projection 216 engages arm 218, arm 218 opens the remaining circuit to motor 180 and interrupts power to the motor 180. Because more than 180° of rotation is available to the pusher 222 after it disengaged from tab 236, a wide range of positions for lever arm 218 and 237*c* are available for terminating operation of the motor 180.

The motor 180 is thereafter automatically reenergized on release of the spring 70 and clockwise rotation of the crank 164 to enable closure of the microswitch under control of arm 237*c*. When the crank 164 is rotated clockwise by spring 70, the crank arm 176 disengages from the handle lock 200 and the spring 237*g* then returns lock 200 and levers 237*b* and 237*e* to a normal position controlled by a stop carried by an adjustment screw 263 extending through a tab on arm 237*e* for engagement with the adjacent front frame wall 54. Lever 237*b* operates arm 237*c* for closing the motor circuit and the arm 237*e* controls indicator 96 to indicate the spring discharge. Clockwise pivoting of the positioner or lock 200 under the bias of spring 237*g* is limited by screw 263 which limits the movement of lock 207 through pin 237*a*.

As previously mentioned, movement of handle link 186 by the handle 98 may also rotate ratchet 188. This is usually done in the event power to the motor is unavailable and the spring 70 has been discharged, since it is desired to maintain the spring 70 in charged condition. When link 186 is pivoted clockwise as seen in FIGS. 4, 4*j* or 8*b* about the axis of pin 187, the pin 184 and corresponding end of pull link 182 is also pivoted clockwise while pawl 192 pulls the engaged tooth 190 and ratchet 188 counterclockwise about the axis of pin 166. The pin 196 in the meantime moves from the enlarged portion of the slot 198 in the handle lock 200 into the elongate portion of the slot 198.

The stop pawl 201 rides over the rear surface of the respective tooth 190 during rotation of ratchet 188 by either pawls 192 or 202 and then engages the radial face of the succeeding ratchet tooth 190 to prevent the ratchet 188 from rotating backwards or clockwise when pawl 192 disengages from the ratchet 188.

The operator on reaching the end of the stroke of link 186 reciprocates the link 186 and pawl 192 in the reverse direction. Pivoting link 186 in the reverse or counterclockwise direction moves pin 196 to the forward or right end of slot 198 and pawl 192 simply rides over the back or circumferential face of the succeeding tooth 190 and on alignment with the radial face of the succeeding tooth, pin 196 moves into the enlarged portion of slot 198 under the influence of spring 197 to engage with the radial face of the succeeding tooth 190. The pawl 192 may now again be operated to advance the ratchet an additional increment.

During each incremental rotation of ratchet 188 with the pusher 222 engaged with tab 234, the crank 164 is also incrementally advanced in a manner already described to tense spring 70. As the crank 164 reaches 170° of rotation and the position where pusher 222 disengages from tab 234, the crank arm 176 engages the axially extending tab or pin 237 on the positioner 200 to operate the label arm 237*e* for providing the spring charge indication and disconnect one circuit to the motor 180 at arm 237*c*. The crank advance moves the handle lock 200 about the axis of shaft 166 under the influence of tab 237 to position a surface 263' in the path of the pin 196 so that it intercepts pin 196 when the pawl is reciprocated to engage a succeeding ratchet tooth. Surface 263' therefore subsequently prevents pawl 192 from engaging the radial face of a succeeding tooth 190.

Thus the reciprocating movement of the link 186 to move the pawl 192 into engagement with the succeeding ratchet tooth 190 is prevented just after pusher 222 disengages from tab 234, since surface 263' of the slot 198 is now transverse to or in the path of movement of the pin 196. The pawl 192 is therefore held from engaging a succeeding ratchet tooth 190 and movement of the ratchet 188 in the spring charging direction by the link 186 is now prevented. If continued manual movement of the ratchet was allowed, and the cam projection 216 brought to rest at some indeterminate position past switch arm 218, spring 70 would not be fully charged by pusher 222 during a subsequent spring charging cycle or misalignment could occur. The positioner or handle lock 200 cannot be returned as the positioner is held by the engagement of tab 237 with arm 176 of crank 164 which in turn is held by the closing latch 248. The operator now knows by the handle feel and the indicator 96 that the spring 70 is fully charged.

If during the manual charging operation, the motor 180 should be energized through the switch controlled by lever 218, the rotation of pawls 202 to drive the ratchet 188 and crank 164 creates no problem, as the ratchet 188 is merely advanced in the same direction and at substantially the same rate as advancement by the manual operation of pawl 192 so that the pawls 192 or 202 may at times alternately engage and advance the ratchet 188 and the crank 164 to tense spring 70. If power should be applied to the motor 180 after the manual charging of spring 70, the ratchet 188 is simply advanced as explained until projection 216 on cam 212 engages arm 218 to open the remaining circuit to motor 180.

As before explained the closing latch surface 262 engages in notch 260 and behind tab 252 when the spring 70 is fully charged and thereafter the pusher 222 is disengaged from the crank tab 234, while the handle lock or positioner 200 is moved by arm 176 to control indicator 96 and prevent further engagement of pawl 192 with the ratchet teeth and to open one circuit to the motor 180 at switch arm 237*c*.

Rotation of the ratchet 188 by the motor 180 may continue as explained until the cam projection 216 on cam member engages the lever arm 218 to open the parallel circuit to the motor and terminate further motor operation.

Operation of the push to close button 92 to discharge spring 70 for closing contacts 26 and 28, depresses the link 254 against the bias of spring 256, if the contacts 26 and 28 are open and the interlock assembly 94 does not prevent operation of link 254. Depressed link 254 pivots the closing latch 248 to disengage the surface 262 from tab 252. The crank 164 is now free to rotate clockwise as seen in FIGS. 4, 4*c*, 4*j* and 8*a* under the influence of spring 70 to in turn drive the follower arms 172 to the right for erecting the toggle assembly 56. The left edge of slot 170 engages pin 61 as indicated schematically at C2 in FIG. 9*a* to move the pin 61 to the right, thereby moving the toggle links 58 and 60 into their erected or aligned position with pin 61 engaged with stop assembly 264 as shown in FIG. 4 and schematically in FIG. 9.

If the breaker is not held tripped and is therefore latched by engagement of the back leg 266 of link 62 with a latch 267 of latch assembly 66, the toggle assembly 56 may be erected to close contacts 26 and 28. The blade carriers 22 and 22*a* pivot clockwise in response to the action of the toggle links 58 and 60 against the force of springs 74, and after contacts 26 and 28 engage, against the force of springs 126.

The discharge of spring 70 pivots the crank 164 and the carriers 22 and 22*a* clockwise and after contacts 26 and 28 engage, springs 126 are compressed to apply the desired pressure to contacts 26 and 28. When the pin 61 engages the stop assembly 264, the pin 162 is located adjacent top dead center of the crank as indicated in FIGS. 4 and 8.

During clockwise movement of the crank 164 to erect the toggle links 58 and 60, the crank disengages from tab 237 while tab 252 returns the trip assembly 238 to normal. Pin 237*a* and lever 237*b* now pivot with positioner or lock 200 under the influence of spring 237*g* to pivot the label arm 237*c* until the stop on screw 263 terminates movement in the spring discharge position. Lever 237*b* also causes switch lever arm 237*c* to reenergize the motor 180.

With the motor 180 reenergized, the ratchet 188 is again rotated to move cam projection 216 from engagement with lever arm 218 to complete a parallel circuit to the motor 180 and the ratchet movement continues. The pusher surface 232 thereafter again engages tab 234 on the crank 164 and rotates the crank for again charging spring 70 while the end of slot 170 disengages from pin 61.

Thereafter rotation of the crank 164 continues and when spring 70 is fully charged the pusher 222 disengages from tab 234 while the switch lever arm 237*c* and the label arm 237*e* are again operated as previously explained to interrupt one circuit to the motor 180 and to indicate the spring charged condition. The left edge of slot 170 is withdrawn from engagement with pin 61. Movement of the ratchet continues as one circuit to the motor 180 remains energized at switch arm 218 until the cam projection 216 engages lever arm 218.

At that time the motor 180 is deenergized and the spring 70 remains fully charged until again discharged by operation of the push to close link 254, while the toggle assembly remains erected as latch 267 prevents pivoting movement of the latch link 62 under the influence of opening springs 74. Thus the spring 70 is automatically returned to a charged condition in response to its discharge for closing contacts 26 and 28.

Stop Assembly

Figure 7:
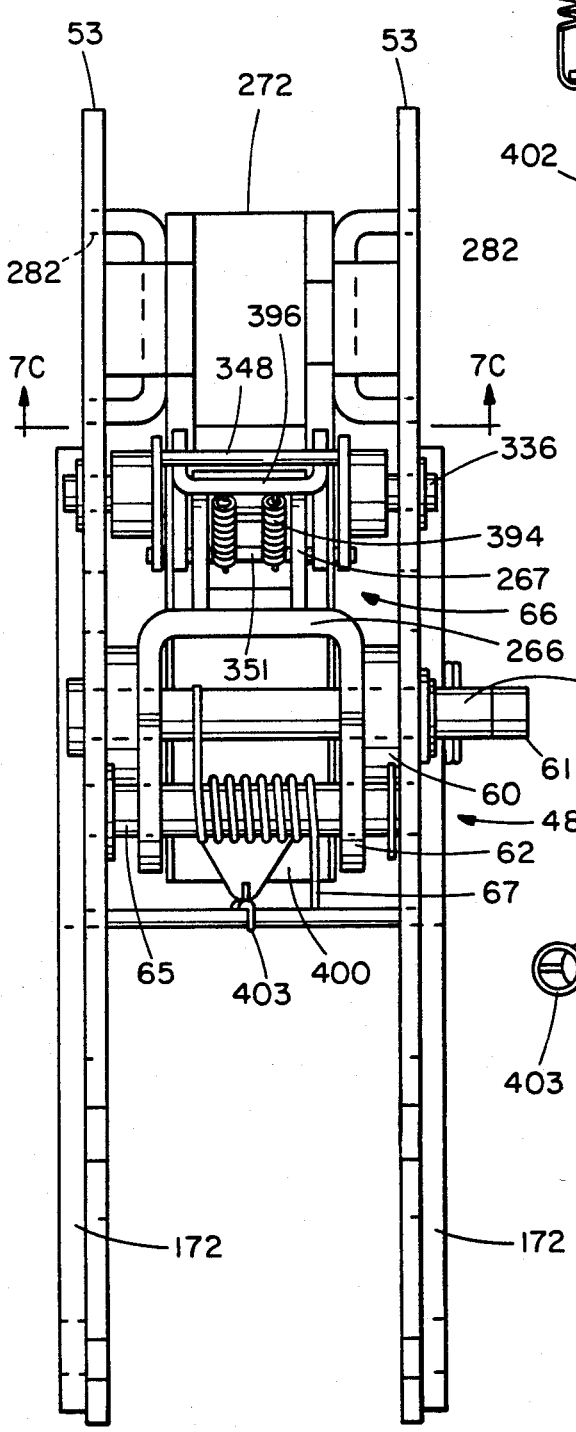
FIG. 7 is a top elevational view of the operating and stop assembly in the center frame compartment.
Figure 7A:
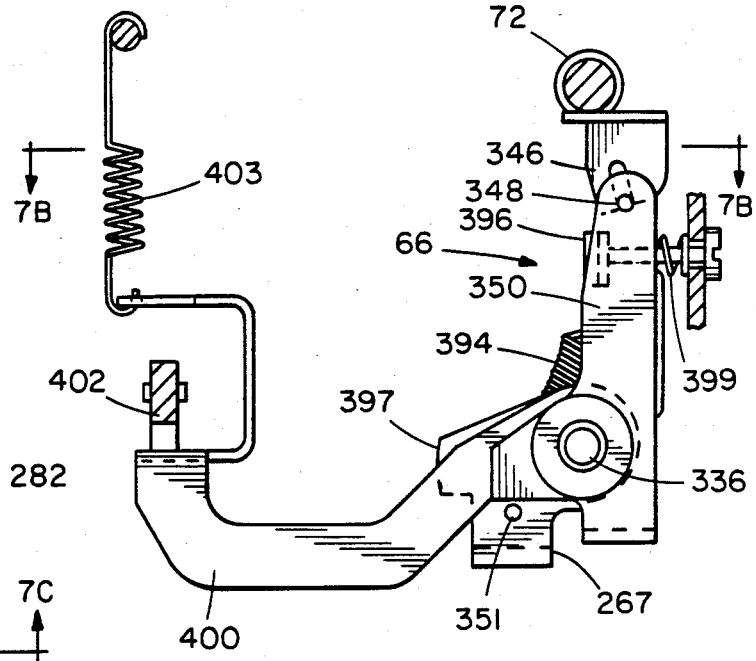
FIG. 7*a* is a side elevational view of the latch assembly.
Figure 7B:
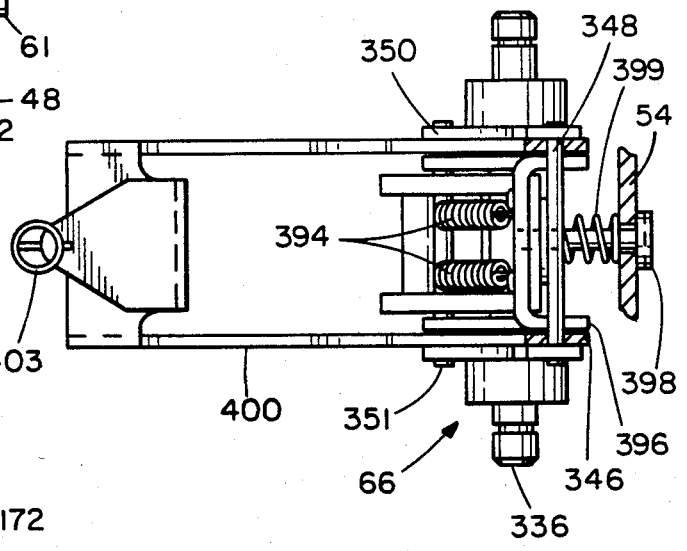
FIG. 7*b* is a sectional view of the latch assembly taken generally through the line 7*b*—7*b* in FIG. 7*a*.
Figure 7C:
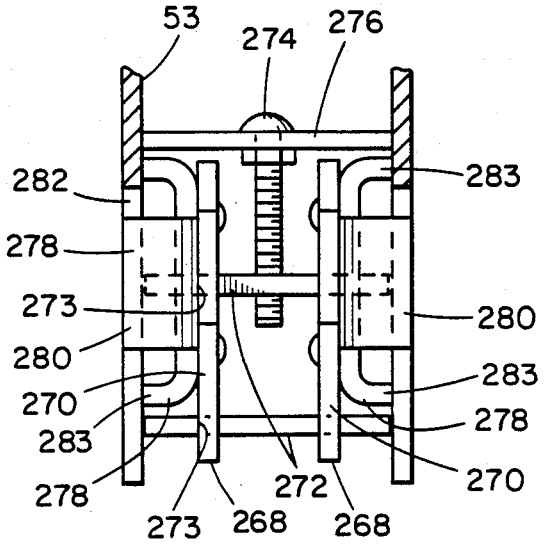
FIG. 7*c* is a sectional view of one portion of the stop adjustment assembly taken generally along the line 7*c*—7*c* in FIG. 7.
Figure 7D:
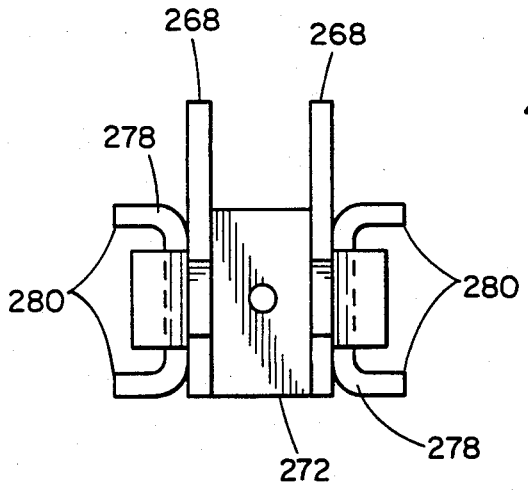
FIG. 7*d* is a top elevational view of one portion of the stop adjustment assembly.
Figure 7E:
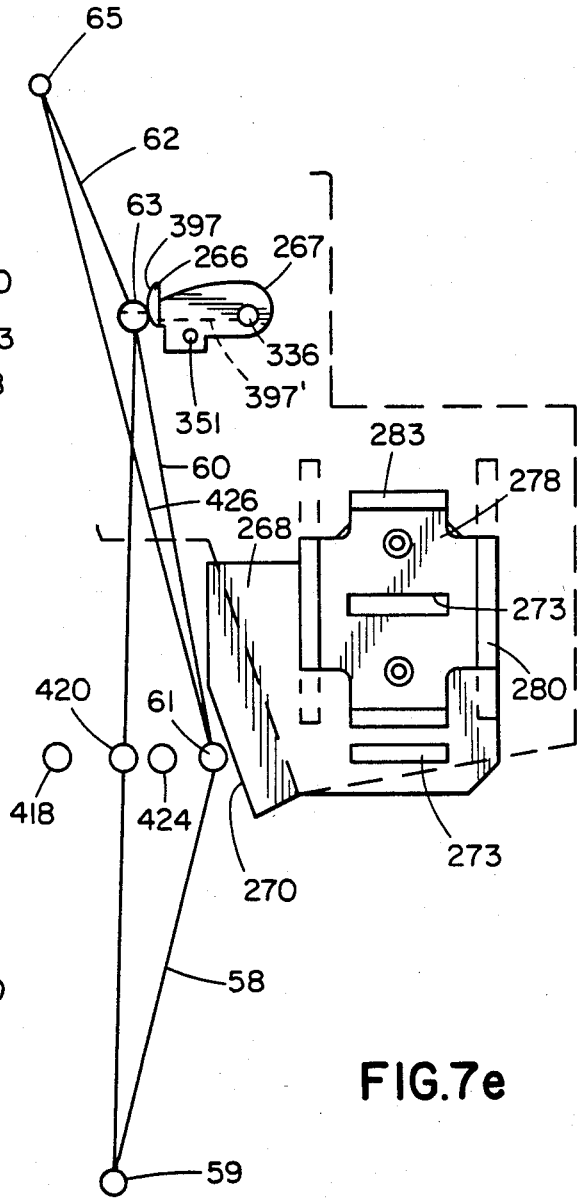
FIG. 7*e* is an elevational view of one stop plate of the stop adjustment assembly with a relevant portion of frame intermediate walls shown in dashed lines and a schematic illustration of the relationship created between the toggle links by the stop adjustment assembly.
Figure 9:
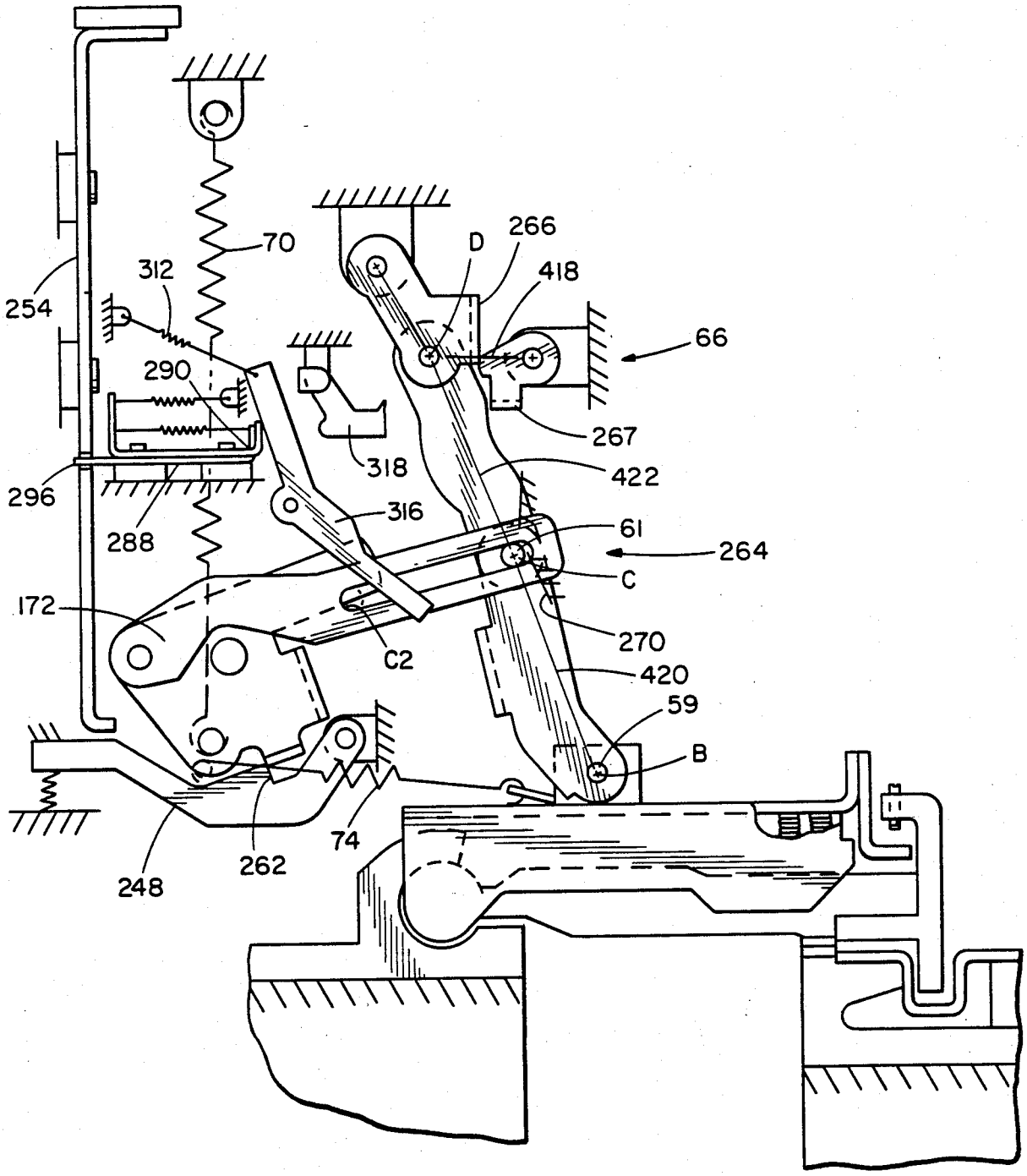
FIGS. 9 and 9*a* are schematic views respectively illustrating the relationship between the charge assembly, the toggle assembly and the interlock assembly in the contact closed and in different contact opening positions.

The stop assembly 264 comprises a pair of spaced stop plates 268 as seen in FIGS. 7*c* and 7*d* each having an angled or oblique stop surface 270 adapted to be engaged by pin 61 as for example indicated in FIGS. 7*e* and 9. The plates 268 are spaced by a pair of spacer plates 272 each of which has side tabs extending through a respective slot 273 in each plate 268. The upper plate 272 receives an adjustment screw 274 extending through a tab 276 at the lower edge of one frame end wall 54 as for example seen in FIG. 4*c*. Screw 274 is provided for moving the plates 268 and surfaces 270 vertically and thereby control the position at which pin 61 engages surfaces 270.

Each stop plate 268 is positioned adjacent a respective portion of intermediate frame walls 53 projecting below and past the adjacent end wall 54 and a U-shaped clip 278 is secured to each plate 268.

Each clip 278 has a slot coincident with one of the slots 273 in each plate for receiving a respective tab on one of the plates 272 and each has side legs 280 adapted to ride in a respective vertical slots 282 formed in the portion of walls 53 projecting forwardly of the front frame wall 54 to prevent rotation of plates 268 during adjustment of screw 274. Horizontal flanges 283 on the back leg of clips 278 engage the inner surface of the projecting portion of walls 53 and serve with legs 280 and spacer plates 272 to rigidify the stop assembly and prevent movement of the stop plates 270 in response to engagement by pin 61.

Thus by vertical adjustment of plates 268 a relatively large movement of screw 280 provides a relatively small change in position at which pin 61 engages surfaces 270 and therefore the load on the latch 267 as will be explained.

Interlock Assembly

The interlock assembly 94 as seen for example in FIGS. 6, 6*a*, 6*d*, 6*e*–6*g* and 6*i* is located in the frame compartment 55*b* and comprises a support plate or bracket 284 having a vertical leg secured to one of the side walls of the frame 50 adjacent the push to close link 254. A horizontal leg 286 of the plate 284 supports a pair of slides 288 and 290 in a stack with slide 288 sandwiched between leg 286 and slide 290. A pair of pins 292 extending through respective elongate slots 294 in slides 288 and 290 secure the slides to leg 286 and permit the slides to move relative leg 286.

The slide 288 has a projection 296 thereon to engage a stop edge 298 on the push to close link 254 when the contacts 26 and 28 are closed and the interlock assembly 94 is effective to prevent movement of the link 254 from its normal or unoperated position and therefore prevent release of the closing latch 248 and spring 70.

The interlock assembly slide 288 is biased toward the link 254 by a spring 300 extending between a tab 302 at the end of slide 288 spaced from link 254 and an L-shaped tab 304 at the end of slide 290 adjacent link 254. Slide 290 is biased from link 254 by a spring 306 connected between tab 304 and a depending tab 308 located on a right angle bend 310 extending from a vertical leg of bracket 284. However, a strong spring 312 connected between tab 314 on bracket leg 286 adjacent link 254 and the upper end of a stop lever 316 normally holds slide 290 adjacent link 254 to in turn prevent retraction of slides 290 and 288 by spring 306 and the projection 296 from disengaging from link edge 298.

Lever 316 is pivotally supported intermediate its ends on a tab depending from horizontal leg 286 and spring 312 normally biases the lever 316 in a counterclockwise direction to engage the upper end of lever 316 in a slot 317 of slide 290 to prevent the slide from moving in a direction from link 254 and carrying slide 288 therewith. An arm projecting from the upper end of the lever 316 engages against the top surface of the slide 290 to limit rotation of lever arm 316 and therefore the distance that slides 290 and 288 are moved toward link 254. With slide 290 restrained against movement away from link 254, the spring 300 cannot retract slide 288 and the projection 296 is normally positioned to prevent operation of link 254.

Figure 9A:
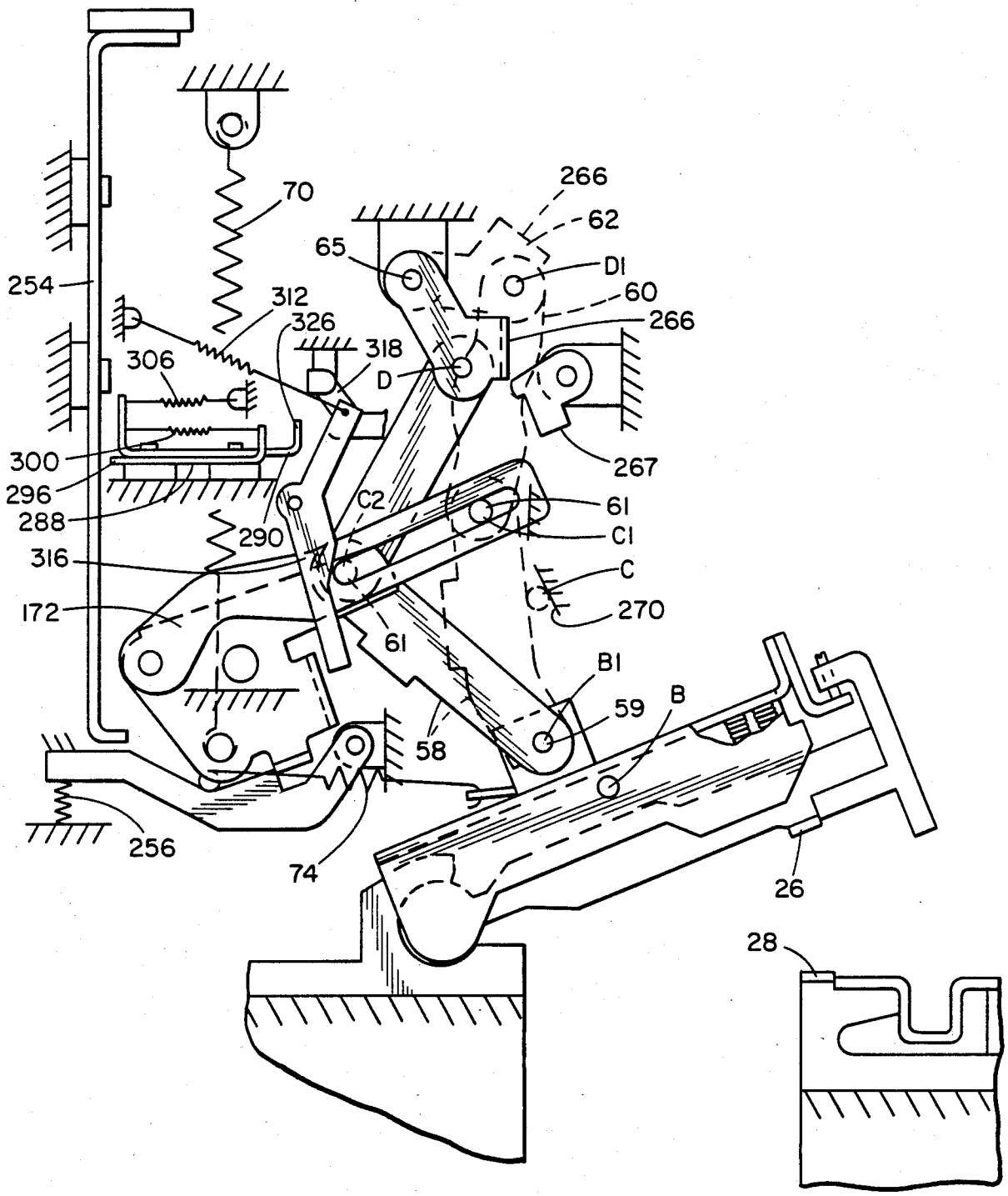

The depending portion of interlock lever 316 is adapted to be engaged by pin 61 when pin 61 is retracted toward position C2 shown in FIGS. 9 and 9*a* adjacent the left end of slot 170 on opening of the contacts 26 and 28 by the opening springs 74. Thus when the toggle assembly 56 collapses and pin 61 is retracted to the open position pin 61 engages lever 316 to pivot the lever clockwise as seen for example in FIGS. 6*b* and 9*a*. The lever 316 then disengages from slot 317 to permit slides 290 and 288 to move from link 254 under the influence of spring 306 unless an interlock arm 318 is operated.

Interlock arm 318 is pivotally carried by a U-shaped bracket structure 319 on bend 310. The interlock arm 318 is generally U-shaped and is pivotally mounted on bracket 319 adjacent the upper end of one leg. A torsion spring 320 wrapped about the pivot pin supporting arm 318 biases the arm 318 counterclockwise to place a stop tab 322 located adjacent the upper end of the one leg in overlapping relationship to bend 310, unless the solenoid or latch assemblies 76 and 66 respectively are operated. A second stop 324 adjacent the back leg of the arm 318 is adapted to engage a tab 326 on slide 290 only during the period the latch assembly 66 or the solenoid assembly 76 are being operated to trip the breaker as will be explained.

The other leg of arm 318 carries a pin engaged in an obliquely extending slot 328 formed in the end of one leg of a latch and interlock actuator 330. Actuator 330 is controlled in response to the operation of the latch assembly 66 or the solenoid assembly 76 to place stop 324 against tab 326 for preventing projection 296 from disengaging from link 254, when the breaker is initially tripped or held tripped as indicated in FIGS. 6*a* and 9*a*.

Solenoid and Latch Assemblies

The actuator 330 has a U-shaped appendage or fold 332 at the leg end opposite slot 328 and is pivotally supported in frame compartment 55*b* by a pin 334. Pin 334 is located on axis just above a latch pivot pin 336 pivotally supporting a latch 267 of the latch assembly 66 as for example seen in FIGS. 6–6*c*, 6*i* and 7–7*b*.

The U-shaped appendage 332 of the actuator 330 is slotted at its upper end for receiving a pin 338 connected to one leg of an auxiliary trip arm 340 having an L-shaped projection 341 extending through the adjacent frame end wall 54 for operation by member 80 under control of the push to trip button 90. Arm 340 is fixed to trip shaft 72. In addition a latch lever striker pin 342 extends between the legs of appendage 332 for engagment by a latch lever 344 of the solenoid assembly 76. Actuator 330 is therefore pivotable by either the latch lever 344 or the auxiliary trip arm 340 to pivot the interlock arm 318 to place stop 324 against tab 326 when the circuit breaker is tripped.

The auxiliary trip arm 340, as mentioned, is fixed to the trip bar or shaft 72 which is pivotally supported in the walls of the frame 50 just above the latch assembly 66. The trip shaft 72 extends into the intermediate frame compartment 55 and the back leg of a U-shaped tripper guide 346 is fixed to the shaft 72 in the compartment 55. The side legs of the tripper guide 346 depend from bar 72 and engage a tripper pin 348 as for example seen in FIGS. 7–7*b*. Pin 348 extends between the side legs of a U-shaped tripper 350 pivotally supported on the pivot latch pin 336, which is located adjacent the back wall of tripper 350.

A projecting portion on each side leg of tripper 350 extends in overlapping slightly spaced relationship to a main latch pin 351. Trip pin 351 also passes through the latch 267 at a position below pin 336 so that pivoting of the bar 72 and tripper 350 under control of actuator 330 pivots the pin 351 and latch 267 counterclockwise about the axis of pin 336 to disengage the latch 267 from link 62. Actuator 330 also pivots arm 318 to engage stop 324 with tab 326 for preventing operation of a push to close link 254. Counterclockwise pivoting of pin 351 independently of actuator 330 under control of the magnetic assembly 78, as will be explained, trips the breaker only.

The latch lever 344 is under control of a coil 352 in the solenoid assembly 76. Coil 352 is supported by a U-shaped heelpiece or yoke 354 secured to the outer wall 52 of the frame above the interlock assembly 94. A concentrator or collector 356 and a permanent magnet 358 are located adjacent one end of coil 352. The coil 352 is adapted to be energized under control of the electronic circuitry as explained in the aforementioned Zylstra application and the magnet 358 serves to hold a spring biased armature 360 in a retracted or operated position. Energizing the coil 352 need only be momentary to counteract the effect of permanent magnet 358 and release the armature 360 under the influence of the armature spring 361 in any well known manner or in a manner similar to that described in U.S. Pat. No. 4,208,690 and its related patents.

The armature 360 on release engages a projection on one leg 362 of a U-shaped latch 364 and a projection on one leg 366 of a U-shaped reset arm 368 as for example seen in FIGS. 6, 6*a* and 6*i*. Latch 364 is pivotally supported by a pin 370 adjacent the upper end of a pair of yoke arms 372 which also pivotally support the latch lever 344 and reset arm 368 by means of a pin 374 located below and forwardly of pin 370.

Latch 364 is biased clockwise about pin 370 by means of a torsion spring 376 wrapped about pin 370 and having one leg engaged with one leg of the yoke and the other leg engaged with a pin 378 passing between the legs of the latch 364. Spring 376 holds the latch leg 362 engaged with armature 360 and the pin 378 positioned to engage with an upper cam or stop surface 380 of the latch lever 344.

Lever 344 has a passage 382 receiving a tab 384 on the leg of reset arm 368 opposite the leg 366. Lever 344 is biased clockwise about pin 374 by a tripping spring 386 to engage stop 380 with pin 378. Pin 378 prevents the latch lever 344 from engaging pin 342 unless the coil 352 is energized at which time the pin 378 is pivoted from the path of stop 380 and spring 386 pivots the latch lever 344 clockwise to engage pin 342 and pivot actuator 330 counterclockwise for disengaging the latch 267 from link 62.

The latch reset arm 368 is biased counterclockwise about the axis of pin 374 toward armature 360 by a reset spring 388. An elongate reset link 390 is pivotally connected at one end to leg 366 of arm 368. Link 390 has an offset portion 391 to avoid engagement by pin 61. It will be understood the carrier 22*a* is shown in the closed position in FIG. 6*a* merely to illustrate its position just prior to opening of the contacts. The other end of link 390 is pivotally connected in a slot 392 formed in a L-shaped bracket 393 secured to the blade carrier 22*a* in the center compartment of the breaker.

The blade carrier 22*a* which in FIG. 6*a* is indicated in closed position at the instant either the trip solenoid assembly 76, magnetic assembly 78 or link 80 is operated, pivots counterclockwise in response to the operation of assemblies 76 or 78 or link 80 under the bias of the opening springs 74 toward the position seen in FIG. 6 to open the contacts 26 and 28. Pivoting the carrier 22*a* enables spring 388 to raise the link 390. Spring 388 moves the reset arm 368 toward the armature 360. If the trip assembly 76 had not been operated, the carrier bracket 393 simply pivots the connection to the link 390, which in turn pivots about the connection to arm 368. Pivoting the carrier also pivots pin 61 upwardly from postion C toward position C1 shown in FIGS. 6*a* and 9*a* if the follower arms 172 are in their advanced position with the spring 70 discharged or pin 61 pivots up from position C to a position to the left and below C1 if the follower arms have been retracted by the charging of spring 70.

If the trip solenoid had been operated, arm 368 engaging armature 360 moves the armature 360 toward the magnet 358 against the bias of spring 361 and thereafter the armature 360 is held in its retracted position. As arm 368 pivots, the tab 384 pivots the latch lever 344 counterclockwise to enable the stop 380 to thereafter again engage pin 378.

Thus when armature 360 is released in response to momentary energization of coil 352 under a fault condition, the latch 364 pivots counterclockwise about the axis of pin 370 against the bias of spring 376 to disengage pin 378 from the path of stop 380. The latch lever 344 pivots clockwise about pin 374 under the influence of spring 386 to engage the pin 342 to pivot the actuator 330 counterclockwise. An edge of passage 382 engaging tab 384 enables spring 386 to pivot arm 368 against the bias of spring 388 for moving the reset link 390 toward the lower end of the slot 392 in bracket 393 on carrier 22*a*.

Actuator 330 in turn pivots arm 318 to prevent operation of the push to close link 254 and pivots striker pin 338 to pivot the auxiliary trip arm 340, bar 72 and the trip arm 346 clockwise. The trip arm 346 in turn pivots tripper 350 counterclockwise to pivot pin 351 which pivots the main latch 267. Latch 267 disengages from link 62 and releases the toggle assembly 56 while link 62 pivots about the axis of pin 65 under the influence of opening spring 74 and pin 63 moves upwardly in slots 64. Thereafter spring 67 simply pivots link 62 clockwise about the axis of pin 65 to enable latch 267 to reengage the link 62.

The interlock actuator 330 on pivoting also pivots lever 318 so that stop 324 engages slide 290 as indicated in FIGS. 6*a* and 9 to prevent retraction of slide 290 from link 254 and spring 300 holds slide projection 296 engaged with link 254 to prevent operation of the push to close link 254.

The latch assembly 66 includes a pair of coil springs 394 extending from a generally U-shaped adjustment member 396 to bias the main latch pin 351 and latch 267 clockwise about the latch pivot pin 336 for engaging link 62 to latch the link and hold the toggle assembly 56 erect when the contacts 26 and 28 are closed by release of the closing spring 70. Latch 267 is provided with a ground arcuate end surface 397 seen in FIG. 7*e* for engaging latch link 62 along a radial line 397′ extending from surface 397 to pin 336 so that latch surface 397 moves tangentially to link 62. Engagement of the latch along radial line 397′ between pins 63 and 336 reduces any tendency of the latch to rotate as a result of shock transmitted to the latch from link 62 as that force is exerted along the radial line instead of transverse to that line. Striker pin 351 passes through the arms of member 396 and the position of member 396 is controlled by an adjustment screw 398 to control the position of the latch 267.

Screw 398 is threaded into the upper end or back leg of member 396 and extends through the front end wall 54 of the frame. A coil spring 399 biases the member 396 counterclockwise about pin 336 until the head of screw 398 engages wall 54. Spring 399 which is stronger than springs 394 therefore limits clockwise rotation of pin 351 and latch 267 and also absorbs inadvertent shock tending to create latch disengagement. Spring 399 serves to bias the head of the screw 398 against the adjacent frame wall 54 and therefore the position to which member 396 and pin 351 are moved by spring 399 is controlled by screw 398. This provides the proper position for engaging latch 267 with link 62 for controlling the distance travelled by the latch for disengaging from link 62 and enabling proper operation of striker pin 351 by either trip arm 346 or the legs a U-shaped magnetic tripper 400 under control of the magnetic trip assembly 78.

Magnetic Assembly

The legs of the U-shaped magnetic tripper 400 are pivotally supported on latch pivot pin 336 and pass slightly above the main latch or striker pin 351 to a position generally below and around the latch link pivot pin 63 for engagement by a pivotable arm 402. A bent over portion on the back leg of tripper 400 overlaps the arm 402, and a spring 403 connected between the bent over portion of the tripper 400 and a pin extending between frame walls 53 biases the tripper 400 clockwise about the axis of pin 336 against arm 402 which is under control of the magnetic assembly 78.

One end of arm 402 extends through one of the intermediate walls 53 of the frame and is pivotally supported on a bracket in frame compartment 55*a*. The other end of arm 402 extends to a position in frame compartment 55*b* and is engaged with adjustable link 404 extending downwardly for pivotal connection to a cross link 406.

Cross link 406 is secured to an insulating crossbar 408 which is pivotally supported in passageways formed in the side and intermediate walls 18 of the base 14. Crossbar 408 is overlapped by the insert 124 and has an arm 409 secured thereto in each breaker compartment. Arm 409 extends to a respective armature 410 of each magnetic assembly 78.

The magnetic assemblies 78 each comprise a pair of L-shaped yokes 412 having a legs extending through respective passages in opposite sides of the respective load conductor 40 and are secured thereto. The other leg of each yoke is engaged with the bottom surface of the conductor. A spring 414 located between the legs of each yoke biases the respective armature 410 from the load conductor 40 toward the upper end of a respective slot in a pair of spaced apart aluminum or non-magnetic armature guides 415 secured to the upper surface of load conductor 40. The armature 410 is U-shaped with its legs directed toward the legs of yoke 412 for attraction thereby.

In response to a predetermined high short circuit current in the respective load conductor 40, the respective armature 410 is moved against the respective spring bias toward the respective load conductor 40 to in turn pivot bar 408. Crossbar 408 pivots link 406 to in turn pull link 404 downward. Link 404 pivots arm 402 against tripper 400 whose legs move against the main latch pin 351 to pivot latch 267 counterclockwise for disengaging the latch 267 from link 62 and enabling collapse of the toggle assembly 58.

General Operation of the Breaker

It will be understood from the foregoing that the closing spring 70 is fully charged or tensed when the breaker contacts 26 and 28 are closed. Thus the spring 70 is charged in response to the closure of the circuit to motor 180 when the lever or switch arm **237*c* is actuated by arm 237*b*, as the crank arm 176 disengages from the handle lock tab 237, under control of the operated push to close link 254 to close the contacts 26 and 28. Energization of the motor 180 continues until cam projection 216 engages switch arm 218 while the spring 70** remains charged.

If no power were available the spring 70 may of course be manually charged through operation of the link 186 and the pawl 192 and when the arm 176 engages tab 237, the pawl 192 cannot be reciprocated due to the surface 263'. If power should be applied to motor 180 during or after manual operation, the ratchet 188 is simply advanced with cam 212 as previously explained until the projection 216 deenergizes the motor 180 at switch arm 218, while the spring 70 remains charged.

With the spring 70 charged and the contacts 26 and 28 closed as indicated schematically in FIG. 9, the left end of the slots 170 in follower arms 172 are withdrawn from pin 61 which is at the position C, while the pin 59 is at position B and pin 63 at position D with the latch 337 engaged with link 62.

When the latch 267 is pivoted counterclockwise under the influence of either the solenoid assembly 76, the magnetic assembly 78 or the push to trip link 80 respectively, as indicated in FIG. **6*a*, the opening springs 74 and springs 126 and/or electromagnetic forces pivot the carriers 22 and 22*a* counterclockwise and pin 59 moves from point B to point B1 as shown schematically in FIG. 9*a*. The flange 128 on the carriers 22 and 22*a* engage the screws carried by the respective horns 114 to then open the respective contacts 26 and 28 in the described sequence for example, while any arc therebetween is transferred to the arc runner plate 106 as described. During the movement of the carriers 22 and 22*a*, the links 58 and 60 initially move upwards to the position indicated by dotted lines 416 in FIG. 9*a* as the latch link 62 pivots counterclockwise to the position indicated by dotted lines in FIG. 6*a* and 9*a* since pin 63 is free to move in slots 64** from point D to point D1.

The pin 61 thus moves first upward from point C to point C1 if the crank is in a position where spring 70 is discharged and then to the left in follower arm slots 170 to point C2, under the influence of spring 67. If the crank is in the spring charge position the pin 61 takes a path to the left and below point C1. The follower arms 172 simply pivot to accommodate this movement. The pin 63 following the movement of links 58 and 60 is then moved from point D1 at the upper end of slot 64 back to point D under the influence of its bias spring 67. The latch 267 therefore reengages the back wall 266 of latch link 62 after first pivoting counterclockwise to enable the wall 266 to pass the latch. The breaker is now latched or reset and prepared for closure of contacts 26 and 28 by discharge of spring 70.

As the carrier **22*a* pivots counterclockwise, the reset spring 388 moves reset link 390 upwardly. The leg 366 of arm 368 in the solenoid assembly 76 is pivoted counterclockwise against the armature 360 to reset the armature 360, if it had been operated. It will be understood that the solenoid assembly 76 is only operated momentarily to assume the position shown in FIG. 6*a* and then is free to be reset. By resetting the trip solenoid in response to the movement of the carrier 22*a*, the power required to operate the trip solenoid is reduced, since the trip solenoid need not directly release latch spring 388** or store energy therein for resetting.

Movement of reset arm 368 engages tab 384 with one edge of passage 382 in the latch lever 344 to pivot the lever 344 counterclockwise. Pin 378 rides over the back surface of the latch lever 344 to position the pin 378 to engage stop surface 380 of the latch lever 344. Had the armature 360 been in its normal or retracted position at the time carrier **22*a* pivots clockwise, the arm 368 is simply retained adjacent the armature 360 by the spring 388 for no purpose as the armature 360** is then in its retracted position.

During the movement of the pin 61 from position C1 or adjacent position if the closing spring is charged to the left in slots 170 to point C2, the end of pin 61 in compartment **55*b* engages arm 316 of the interlock assembly 94. Arm 316 pivots clockwise against the bias of spring 312 as indicated in FIG. 9*a* to thereby enable slide 288 to move to the right unless slide 290 is restrained by arm 318 under control of the actuator 330**.

Actuator 330 is only temporarily operated by the solenoid assembly 76 and assumes the position shown in FIG. **6*a* temporarily to momentarily move the interlock arm 318 to the position shown in FIG. 6*a* or by dashed lines in FIG. 9*a*. With arm 318 in the position shown in FIG. 9*a*, stop 324 is engaged with tab 326 to hold projection 296 momentarily engaged with link 254. Actuator 330 may also be held operated manually at link 80 by the push to trip button 90 in which case arm 318 holds projection 296 engaged with link 254 as long as actuator 330** is held operated.

Assuming actuator 330 is returned to normal by resetting of the trip solenoid on opening of the contacts, arm 318 is also returned to normal. Slide 290 moves to the right, as seen in FIG. **9*a*, under the influence of spring 306 thereby causing spring 300 to pull slide 288 to the right and disengage projection 296 from the push to close link 254. Link 254 may thus be operated to thereafter discharge spring 70**.

Had the carriers 22 and **22*a* been released under high short circuit conditions, the force of opening may be sufficient for bracket 46***a* to engage surfaces 139 on the catchers 136, after bracket 46*a* and members 131 strike the stop and shock assemblies 132. The hooks 140 are pivoted against the bias of springs 138*b* so that they engage pins 133 to prevent such rebound as to result in reclosure of contacts 26 and 28 while the neoprene shock absorber members 137*d* absorb the rebound shock on the hooks 140. When the rebound movement stops, the opening springs 74 move the carriers from hooks 140 allowing the catchers 136 to return to their normal position while the bracket 46*a* and members 131 come to rest against the assemblies 132.

In the event the breaker is held tripped by the push to trip button 90, the link 80 rotates the crossbar or trip shaft 72 clockwise through trip arm 340. Trip shaft 72 rotates the trip arm 350 and the toggle assembly collapses, as explained, for opening contacts 26 and 28, whereafter link 62 returns to the latch position. The latch 267 however is held displaced from and prevented from latching the latch link 62 as long as the trip arm 340 is held operated by link 80. The auxiliary trip arm 340 at pin 338 also rotates the actuator 330 counterclockwise, and the upper edge of slot 328 pivots interlock arm 318 clockwise to bring stop 324 against tab 326 as indicated schematically in FIG. 9*a*. This prevents slides 290 and 288 from moving to the right and disengaging the projection 296 from the push to close link 254 despite the clockwise pivoting of lever 316 by pin 61 as the pin 61 moves from position C1 to position C2. Thus the interlock assembly 94 remains in the position shown in FIG. 9 although lever 316 and arm 318 are in the position shown in FIG. 9*a*. Contacts 26 and 28 therefore cannot be closed as the push to close link 254 is held by projection 296, while the breaker is held mechanically tripped by the push to trip button 90.

When the push to trip button 90 is released, the trip shaft 72 and arm 350 return to normal under the influence of springs 394 while the lever 318 returns to normal under the influence of spring 320. With stop 324 disengaged from tab 326 and pin 61 in position C2 holding lever 316 from slide 299, the slides 290 and 288 move to the right for disengaging projection 296 from the push to close link 254. The link 254 may now be operated by the push to close button 92 for closing contacts 26 and 28, as the spring 70 has normally been charged prior to the opening of contacts 26 and 28.

Depression of the push to close link 254 pivots the closing latch 248 against the bias of spring 256 to disengage the surface 262 from crank tab 252 and the crank 164 rotates clockwise under the influence of spring 70 to in turn move the left end of the slot 170 in follower arm 172 against pin 61 and move the pin 61 and links 58 and 60 along a path toward position C.

As shown schematically in FIG. 7*e*, when pin 61 moves to position 418, the contacts 26 and 28 touch and thereafter spring 70 and arms 172 continue to move the pin 61 against the pressure or bias of springs 126. When pin 61 reaches a position 420 coincident with line 422 extending between pin 63 and pins 59, the links 58 and 60 are aligned to place pin 59 in a maximum depressed position with the force of springs 126 now exerted primarily along the line 422. Pin 61 is moved a short distance past the line 420 by arms 172 to position 424 at which point springs 70 is substantially discharged. With pin 61 moved to an overcenter position just past line 422, the force of springs 126 exerted through link 58 snaps pin 61 an additional short increment to engage surface 270 on plates 268 and locate pin 61 in position C and pin 59 in position B.

Pin 61 in position C is now located in a just overcenter position with the force springs 126 exerted primarily upwardly along links 58, 60 and 62. The force on latch 267 is a function of the distance L between surface 397 and a straight line 426 joining pins 61 and 65 or the sine of the respective angles between links 60 and 62 and line 426. Since large charges in position of stops or plates 268 move inclined surfaces 270 relatively small distances the final position of pin 61 can be easily varied in small increments to provide small angles between links 60 and 62 and line 426 and therefore easily control the load on the latch 267. A portion of the load on pin 61 from springs 126 is also intercepted by surface 270 which is inclined to partially overlap pin 61. The total force required to move the latch is therefore reduced to the load on the latch resulting from the sine of the respective angles between links 60 and 62 and line 426, which is small, multiplied by the coefficient of friction of latch surface 397, which is held to a minimum by grinding the surface 397 on a radius about the axis of pin 236. Despite the low forces required to move the latch, the possibility of inadvertent tripping is reduced as result of the engagement of latch surface with link 62 along a radial line 397' between pins 336 and 62 since forces therebetween are transmitted along the radial line instead of transverse thereto and therefore do not tend to pivot the latch. This also permits the use of a short latch to maximize the resistance or rigidity of the latch.

Since the load on the latch is low and the surface 397 is ground on a radius, so that surface 397 moves tangentially to link 62, the force required to release the latch is minimized. On release of the latch, pin 59 moves upwardly under the force of springs 74 and 112 in turn driving pin 61 upwardly toward position C1 while pin 63 moves upwardly in slots 64. Then as the pin 63 moves upwardly in slots 64, the links 58 and 60 move through a straight line whereafter the pin 61 is constrained to move toward position C2 and the latch link 62 is returned to engage latch 267 under the influence of bias spring 67.

The foregoing is a description of an improved circuit breaker whose inventive features are believed set forth in the accompanying claims.

What I claim is:

1. An interlock assembly for use in a circuit breaker having a tensed closing spring operably discharged by a manually operable spring discharge means for moving a plurality of blades from a contact open position to a contact closed position whereafter said blades are held in said contact closed position by a latch assembly adapted to be released either manually or in response to a selected fault current for enabling said blades to move from said contact closed position to said contact open position, the improvement comprising, a plate; one slide supported by said plate and biased in one direction, said slide operatively associated to engage said spring discharge means in response to movement of said slide in a direction opposite said one direction for preventing operation of said spring discharge means, and means for preventing movement of said slide in said one direction and holding said slide engaged with said spring discharge means to prevent operation of said spring discharge means and discharge of said spring in response to either the release of said latch assembly or said blades assuming a contact closed position.

2. The assembly claimed in claim 1 in which said means for preventing movement of said slide comprises one biased arm carried by said plate and operated after said blades are moved from said contact closed position to said contact open position for enabling said slide to move in said one direction.

3. The assembly claimed in claim 2 in which said means preventing movement of said slide comprises a second biased arm carried by said plate and operated only during release of said latch for preventing movement of said slide in said one direction.

4. The assembly claimed in claim 3, wherein a second slide is carried by said plate, and the bias for said one slide is provided by a spring connecting said second slide to said plate for movement in said one direction, and means interconnecting said one side and said second slide for enabling said one slide to move with said second slide in said one direction.

5. The assembly claimed in claim 3 in which said second arm is moved in response to release of said latch assembly to engage said second slide for preventing movement of said slide in said one direction, and the bias for said one are comprises a spring connected between said plate and said one arm for engaging said one arm with said second slide for preenting movement of said second slide in said one direction.

6. The assembly claimed in claim 5 including an actuator interconnecting said second arm with said latch assembly, means for manually releasing said latch assembly for operating said actuator to operate said second arm, and a trip solenoid energized in response to a selected fault current for operating said actuator to operate said second arm and for releasing said latch assembly.

7. The assembly claimed in claim 6 including a toggle assembly operated by discharge of said closing spring to move said blades to a contact closed position and operated by said latch assembly to move said blades from said contact closed position, and means carried by said toggle assembly engaging said one arm only in response to operation of said toggle assembly by the release of said latch assembly for moving said one biased arm for enabling said slides to move in said one direction.

8. An interlock assembly for use in a circuit breaker having a tensed closing spring operably discharged by a manually operable spring discharge means for erecting a toggle assembly to move a plurality of blades from a contact open position to a contact closed position whereafter said toggle assembly is held erect and said blades are held in said contact closed position by a latch assembly adapted to be controlled for enabling collapse of said toggle assembly to effect movement of said blades from said contact closed position to a contact open position, the improvement comprising, movable means biased in one direction for enabling operation of said spring discharge means, and preventing means automatically operable for preventing movement of said movable means in said one direction in response to said bias to prevent operation of said spring disharge means and discharge of said closing spring in response to either the control of said latch for enabling release of said toggle assembly or the movement of said blades to a contact closed position.

9. An assembly claimed in claim 8 including means carried by said toggle assembly for enabling operating said preventing means for preventing movement of said movable means only in response to the erection of said toggle assembly.

10. An assembly claimed in claim 8 including an actuator, a trip solenoid assembly for operating said actuator in a respective one direction in response to a selected fault current passing through said blades, and means interconnecting said actuator with sid preventing means and with said latch assembly for operating said preventing means to prevent discharge of said closing spring and for controlling said latch assembly to release said toggle assembly in response to movement of said actuator in said respective one direction.

11. An assembly claimed in claim 10, including manually operable means for controlling said latch assembly to release said toggle assembly and means enabling said interconnecting means to operate said actuator in said respective one direction in response to control of said latch assembly by said manually operable means.

12. An assembly claimed in claim 10, including a permanent magnet carried by said trip solenoid assembly, an armature retained by said magnet in a retracted position and movable to a release position to operate said actuator in said respective one direction, a spring biasing said armature toward said release position said armature being released to operate said actuator in response to momentary energization of said trip solenoid, and means for resetting said released armature for thereafter enabling said permanent magnet to hold said armature from operating said actuator.

* * * * *